US006889677B2

(12) United States Patent
Fujima et al.

(10) Patent No.: US 6,889,677 B2
(45) Date of Patent: May 10, 2005

(54) CAPACITOR DISCHARGE IGNITION DEVICE FOR INTERNAL COMBUSTION ENGINE

(75) Inventors: Akifumi Fujima, Wako (JP); Katsuhiko Saito, Wako (JP); Osamu Igarashi, Numazu (JP); Kiyoshi Uemura, Numazu (JP)

(73) Assignees: Honda Giken Kogyo Kabushiki Kaisha, Tokyo (JP); Kokusan Denki Co., Ltd., Shizuoka-ken (JP)

( * ) Notice: Subject to any disclaimer, the term of this patent is extended or adjusted under 35 U.S.C. 154(b) by 0 days.

(21) Appl. No.: 10/771,270

(22) Filed: Feb. 3, 2004

(65) Prior Publication Data

US 2004/0154592 A1 Aug. 12, 2004

(30) Foreign Application Priority Data

Feb. 3, 2003 (JP) ..... 2003-026049
Apr. 25, 2003 (JP) ..... 2003-121514
Oct. 27, 2003 (JP) ..... 2003-366403

(51) Int. Cl.[7] ..... F02P 3/08; F02P 11/02
(52) U.S. Cl. ..... 123/600; 123/599
(58) Field of Search ..... 123/406.57, 599, 123/600, 605; 315/209 SC

(56) References Cited

U.S. PATENT DOCUMENTS 4,046,125 A * 9/1977 Mackie ..... 123/604
4,169,446 A * 10/1979 Jackson et al. ..... 123/605
4,346,690 A * 8/1982 Anderson ..... 123/599
4,566,425 A * 1/1986 Nitou et al. ..... 123/600

FOREIGN PATENT DOCUMENTS

JP 51-41669 3/1984

* cited by examiner

*Primary Examiner*—Tony M. Argenbright
(74) *Attorney, Agent, or Firm*—Pearne & Gordon LLP

(57) ABSTRACT

A capacitor discharge ignition device for an internal combustion engine including an ignition capacitor that is charged with a positive half cycle of an output voltage of an exciter coil, a thyristor that is triggered by a negative half cycle of an output voltage of the exciter coil when the internal combustion engine is ignited to discharge charges stored in the ignition capacitor through a primary coil of an ignition coil, and a reverse bias circuit that applies a reverse bias voltage between a gate and a cathode of the thyristor when a current flowing from the exciter coil through the thyristor is detected and when a charging current of the ignition capacitor is detected.

17 Claims, 12 Drawing Sheets

Fig. 2
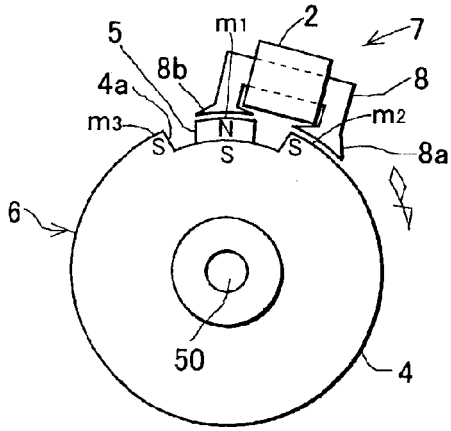
Fig. 3A
Fig. 3B
Fig. 3C
Fig. 3D
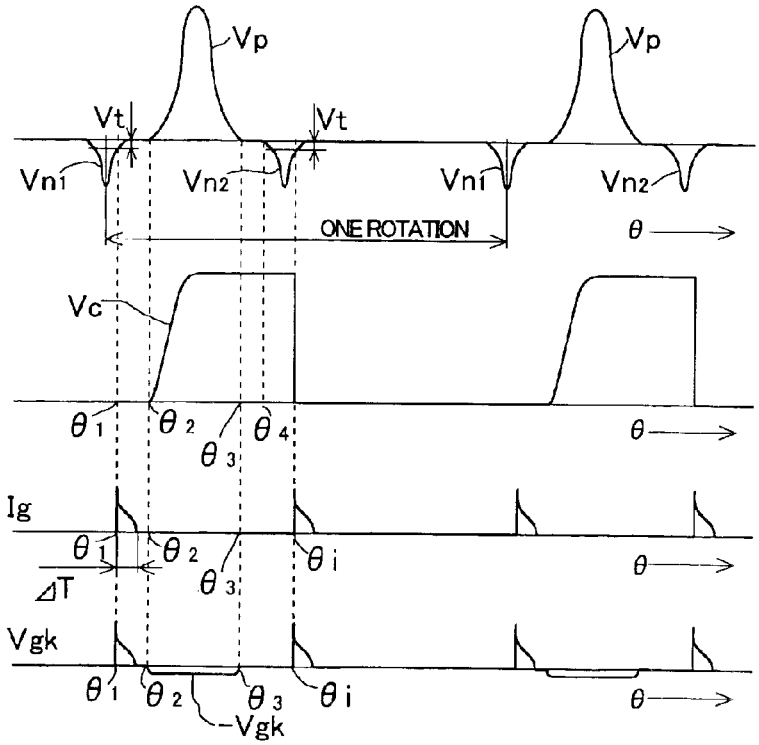

Vp
Vt
Vn1
Vn2
Va1
Vcr1
Vcr2
ONE ROTATION
Tig
Vgk
Vgk´
Sd
H
L
Vc
θ

Tn :TIME (S) FOR ONE ROTATION
θref :REFERENCE SIGNAL POSITION (°)
θig :IGNITION POSITION (°)
Tig :IGNITION TIMER CLOCKING DATA

CAPACITOR DISCHARGE IGNITION DEVICE FOR INTERNAL COMBUSTION ENGINE

TECHNICAL FIELD OF THE INVENTION

The present invention relates to a capacitor discharge ignition device for an internal combustion engine.

BACKGROUND OF THE INVENTION

A general capacitor discharge ignition device for an internal combustion engine is comprised of an exciter coil that is provided in a magneto generator driven by an internal combustion engine and induces an AC voltage in synchronization with rotation of the engine, an ignition capacitor that is provided on a primary side of an ignition coil and charged with one polarity with a positive half cycle of an output voltage of the exciter coil, a thyristor that is turned on when a trigger signal is provided to discharge charges in the ignition capacitor through a primary coil of the ignition coil, and a thyristor trigger circuit that provides the trigger signal to the thyristor at an ignition position in the internal combustion engine.

As disclosed in Japanese Patent Laid-Open Publication No. 59-41669, a magneto generator that comprises a magnet field on an outer periphery of a flywheel has been often used as a magneto generator having an exciter coil as described above. Such a magneto generator includes a magneto rotor that forms a magnet field with three poles by attaching a permanent magnet to an outer periphery of a flywheel, and a stator comprised by winding an exciter coil around a core having magnetic pole portions facing the magnetic poles of the magnet field of the magnet rotor, and generates one-and-a-half cycle of an AC voltage constituted by a positive half cycle of an output voltage and first and second negative half cycles of output voltages generated before and after the positive half cycle of the output voltage, respectively, at least once from the exciter coil during one rotation of a crankshaft.

In a capacitor discharge ignition device for an internal combustion engine using such a magneto generator, as disclosed in Japanese Patent Laid-Open Publication No. 59-41669, an ignition capacitor is generally charged with a positive half cycle of an output voltage generated by an exciter coil to provide a trigger signal to a thyristor by using a negative half cycle of an output voltage generated by the exciter coil.

If the capacitor discharge ignition device for an internal combustion engine using the above described magneto generator is comprised so that the trigger signal is provided to the thyristor by the negative half cycle of the output voltage generated by the exciter coil, charges in the ignition capacitor are discharged through the thyristor for an ignition operation when the trigger signal is provided to the thyristor by an output of a second negative half cycle of an output voltage. The trigger signal is also provided to the thyristor when a first negative half cycle of an output voltage is generated before the exciter coil generates the positive half cycle of the output voltage, but at this time, the charges have not yet been stored in the ignition capacitor, and thus the thyristor does not conduct to cause no ignition operation.

In the capacitor discharge ignition device for an internal combustion engine using the magneto generator having the magnet field with the three poles on the outer periphery of the rotor, when the trigger signal is provided to the thyristor by using the negative half cycle of the output voltage of the exciter coil, the trigger signal is also provided to the thyristor when the first negative half cycle of the output voltage is generated before the exciter coil generates the positive half cycle of the output voltage, but the trigger signal has to be eliminated before the positive half cycle of the output voltage of the exciter coil rises. If the trigger signal is provided to the thyristor when the positive half cycle of the output voltage of the exciter coil rises, the thyristor conducts to short-circuit the exciter coil, thus preventing charging of the ignition capacitor to cause misfire of the engine.

When a sufficient space can be provided between magnetic poles of the magnetic rotor, and a crank angle position where the exciter coil generates the first negative half cycle of the output voltage can be sufficiently separated from a crank angle position where the exciter coil generates the positive half cycle of the output voltage, no trigger signal is provided to the thyristor when the positive half cycle of the output voltage of the exciter coil rises.

However, when the space between the magnetic poles of the magnet rotor has to be narrowed, and the crank angle position where the exciter coil generates the first negative half cycle of the output voltage is close to the crank angle position where the exciter coil generates the positive half cycle of the output voltage, such as when the rotor of the magneto generator has to have a smaller outer diameter, a time is reduced from when the exciter coil generates the first negative half cycle of the output voltage to when the exciter coil generates the positive half cycle of the output voltage during high speed rotation of the engine, and thus a trigger signal current provided to the thyristor by the negative half cycle of the output voltage generated before the positive half cycle of the output voltage may remain when the positive half cycle of the output voltage rises.

Such a state causes the thyristor to conduct to short-circuit the exciter coil when the exciter coil generates the positive half cycle of the output voltage, thus preventing charging of the ignition capacitor to cause misfire of the engine.

Thus, in the capacitor discharge ignition device for an internal combustion engine in which the magneto generator having the exciter coil that generates one-and-a-half cycle of the AC voltage constituted by the positive half cycle of the output voltage and the first and second negative half cycles of the output voltages generated before and after the positive half cycle of the output voltage, respectively, at least once during one rotation of the crankshaft of the internal combustion engine is used to provide the trigger signal to the thyristor by the negative half cycle of the output voltage of the exciter coil, if the space between the magnetic poles of the magnet rotor is narrowed, and the crank angle position where the exciter coil generates the first negative half cycle of the output voltage is brought close to the crank angle position where the exciter coil generates the positive half cycle of the output voltage, the rotational speed of the engine is limited since the charging of the ignition capacitor is prevented during the high speed rotation of the engine.

SUMMARY OF THE INVENTION

Therefore, an object of the invention is to provide a capacitor discharge ignition device for an internal combustion engine in which a magneto voltage constituted by a positive half cycle of an output voltage and first and second negative half cycles of output voltages generated before and after the positive half cycle of the output voltage, respectively, at least once during one rotation of a crankshaft of the internal combustion engine is used to provide a trigger signal to a thyristor by a negative half cycle of an output voltage of the exciter coil, wherein the thyristor is inhibited from conducting to prevent charging of an ignition capacitor when the output voltage of the positive half cycle of the exciter coil rises during high speed rotation of the engine.

The capacitor discharge ignition device for an internal combustion engine according to the invention includes: a magneto generator having an exciter coil that generates one-and-a-half cycle of an AC voltage constituted by a positive half cycle of an output voltage and first and second negative half cycles of output voltages generated before and after the positive half cycle of the output voltage, respectively, at least once during one rotation of a crankshaft; an ignition coil; an ignition capacitor that is charged with one polarity with the positive half cycle of the output voltage of the exciter coil; a thyristor that is turned on when a trigger signal is provided to discharge charges stored in the ignition capacitor through a primary coil of the ignition coil; a thyristor trigger circuit that provides the trigger signal to the thyristor at an ignition position in the internal combustion engine using the negative half cycle of the output voltage of the exciter coil as a power supply voltage; and a trigger inhibiting circuit that inhibits the thyristor from being triggered when a current flowing from the exciter coil through the thyristor is detected and when a charging current of the ignition capacitor is detected.

By providing the trigger inhibiting circuit as described above, even if the positive half cycle of the output voltage of the exciter coil rises with a trigger signal current provided to the thyristor by the negative half cycle of the output voltage of the exciter coil remaining, the trigger inhibiting circuit inhibits the thyristor from being triggered at the moment when the thyristor is about to move to a conducting state, and thus the thyristor cannot move to the conducting state and returns to a blocking state.

When the thyristor returns to the blocking state, the charging current flows through the ignition capacitor, but the trigger inhibiting circuit inhibits the thyristor from being triggered also when the charging current flows, thus ensuring that the thyristor is kept in the blocking state to allow charging of the ignition capacitor without a hitch.

According to the invention, the ignition capacitor can be charged without a hitch even when a crank angle position where the exciter coil generates the negative half cycle of the output voltage is close to a crank angle position where the exciter coil generates the positive half cycle of the output voltage, and when the positive half cycle of the output voltage rises with the trigger signal current of the thyristor remaining during high speed rotation of the engine, thus preventing inconvenience such that the rotational speed of the engine is limited when a rotor of the magneto generator has a smaller outer diameter.

The trigger inhibiting circuit can be comprised of a reverse bias circuit that applies a reverse bias voltage between a gate and a cathode of the thyristor when the current flowing from the exciter coil through the thyristor is detected and when the charging current of the ignition capacitor is detected.

By providing the reverse bias circuit, even if the positive half cycle of the output voltage rises with the trigger signal current provided to the thyristor by the negative half cycle of the output voltage of the exciter coil remaining, the reverse bias voltage is applied between the gate and the cathode of the thyristor at the moment when the thyristor is about to move to a conducting state, and thus the thyristor cannot move to the conducting state and returns to a blocking state. Therefore, the ignition capacitor can be charged with the positive half cycle of the output voltage of the exciter coil to allow an ignition operation without a hitch.

The trigger inhibiting circuit may be comprised of a short circuit that short-circuits the thyristor between the gate and the cathode when the current flowing from the exciter coil through between the anode and the cathode of the thyristor is detected and when the charging current of the ignition capacitor is detected.

BRIEF DESCRIPTION OF THE DRAWINGS

The above and other objects and features of the present invention will be apparent from the detailed description of the preferred embodiments of the invention, which is described and illustrated with reference to the accompanying drawings, in which;

FIG. 2 is a front view of a construction example of a magneto generator used in an ignition device according to the invention;

FIGS. 3A to 3D show an output voltage waveform of an exciter coil, a waveform of a voltage across an ignition capacitor, a waveform of a trigger signal current provided to a thyristor, and a waveform of a trigger signal voltage provided between a gate and a cathode of the thyristor of the ignition device in FIG. 1;

DETAILED DESCRIPTION OF THE PREFERRED EMBODIMENTS

Now, embodiments of the invention will be described with reference to the drawings.

First Embodiment

Figure 1:
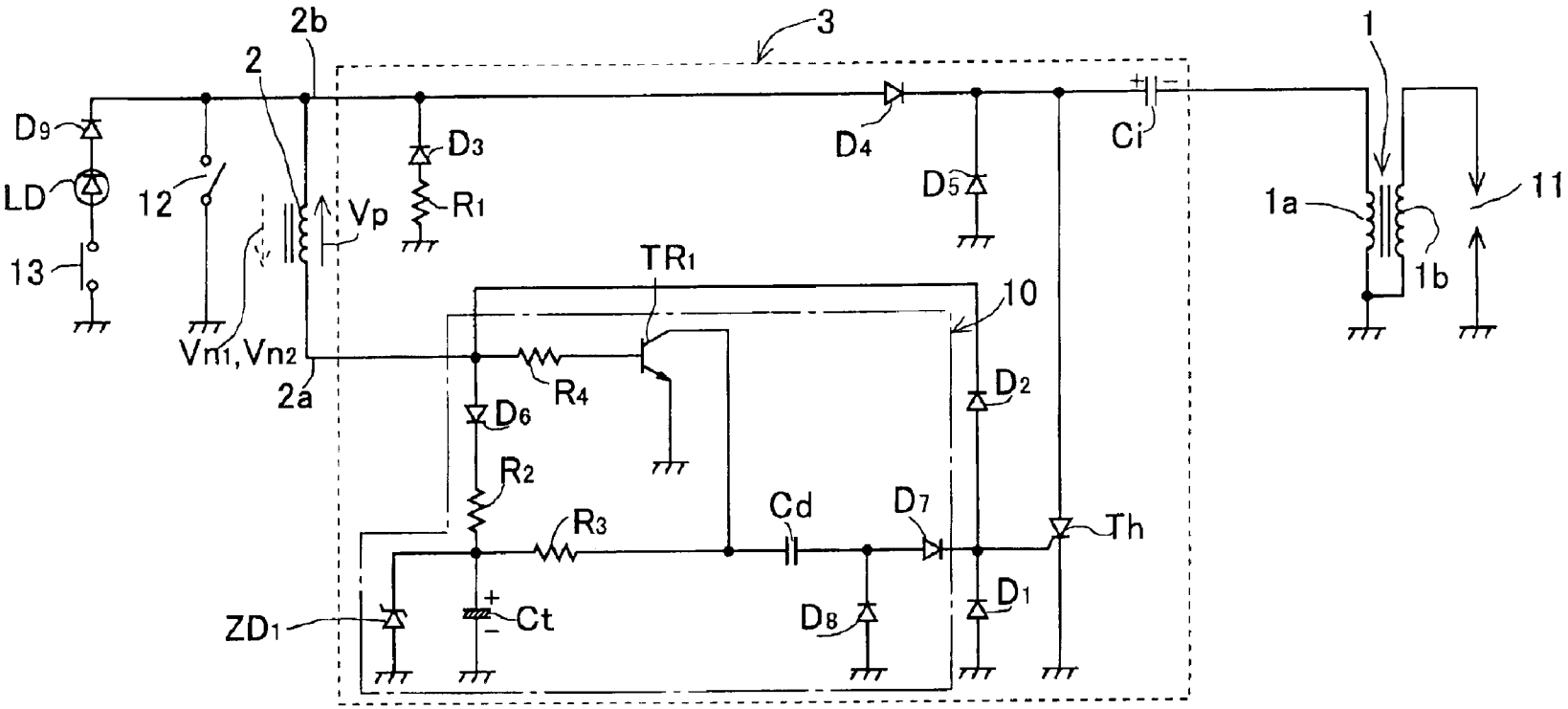
FIG. 1 is a circuit diagram showing a construction of a first embodiment of the invention.

FIG. 1 shows a construction of a first embodiment of the invention. In this embodiment, a case where a single cylinder internal combustion engine is ignited is adopted as an example. In FIG. 1, a reference numeral 1 denotes an ignition coil having a primary coil 1*a* and a secondary coil 1*b* with one end of each coil being grounded, a reference numeral 2 denotes an exciter coil provided in a magneto generator driven by a two-cycle internal combustion engine, and a reference numeral 3 denotes a capacitor discharge ignition unit.

The magneto generator having the exciter coil 2 is comprised, for example, as shown in FIG. 2. In FIG. 2, a reference numeral 4 denotes an iron flywheel mounted to a crankshaft 50 of the internal combustion engine, and a reference numeral 5 denotes an arcuate permanent magnet mounted in a recess 4*a* provided in an outer periphery of the flywheel 4, and a magnet rotor 6 is comprised of the flywheel 4 and the permanent magnet 5. The permanent magnet 5 is polarized diametrically of the flywheel, and a magnet field is formed on the outer periphery of the flywheel 4, which has three magnetic poles: a magnetic pole m1 diametrically outside the permanent magnet 5 (the north pole in the shown example), and a pair of magnetic poles m2 and m3 led out from a magnetic pole inside the magnet 5 (the south pole in the shown example) to an outer peripheral surface of the flywheel on both sides of the recess 4*a*.

Further, a reference numeral 7 denotes a stator secured to a casing or the like of the engine. The stator is comprised of a core 8 having, at both ends, magnetic pole portions 8*a* and 8*b* facing the magnetic poles of the magnet rotor 6, and the exciter coil 2 wound around the core 8, and the magneto generator is comprised of the stator 7 and the magnet rotor 6.

As shown in FIG. 3A, the exciter coil 2 generates one-and-a-half cycle of an AC voltage constituted by a positive half cycle of an output voltage Vp and first and second negative half cycles of output voltages Vn1 and Vn2 generated before and after the positive half cycle of the output voltage only once during one rotation of the crankshaft 50.

The ignition unit 3 in FIG. 1 includes an ignition capacitor Ci that is charged with one polarity with the positive half cycle of the output voltage Vp of the exciter coil 2, a thyristor Th that is provided so as to conduct when a trigger signal is provided to discharge charges stored in the ignition capacitor Ci through the primary coil 1*a* of the ignition coil 1, and a thyristor trigger circuit 10 that provides the trigger signal to the thyristor Th at an ignition position in the internal combustion engine using the negative half cycles of the output voltages Vn1 and Vn2 of the exciter coil 2 as a power supply voltage.

In the ignition device in FIG. 1, one end of the ignition capacitor Ci is connected to an ungrounded terminal of the primary coil 1*a* of the ignition coil, and the thyristor Th is provided between the other end of the ignition capacitor Ci and the ground with its cathode directed to the ground.

In this embodiment, a positive current feedback circuit that constructs a return circuit of a current flowing out of the exciter coil when the exciter coil 2 outputs the positive half cycle of the output voltage Vp is comprised of a first feedback diode D1 connected between a gate and the cathode of the thyristor Th with its anode directed to the ground, and a second feedback diode D2 connected between the gate of the thyristor and one end 2*a* of the exciter coil 2 with its anode directed to the gate of the thyristor Th.

Also, a third feedback diode D3 with its anode directed to the ground is provided between the other end 2*b* of the exciter coil 2 and the ground, and a negative current feedback circuit that constructs a return circuit of a current flowing out of the exciter coil 2 when the exciter coil 2 outputs the negative half cycles of the output voltages Vn1 and Vn2 is comprised of the third feedback diode D3. In the shown example, a resistor R1 as a current limiting element is inserted between the anode of the third feedback diode D3 and the ground.

An anode of a charging diode D4 whose cathode is connected to the other end of the ignition capacitor Ci is connected to the other end of the exciter coil 2, and when the exciter coil 2 outputs the positive half cycle of the output voltage Vp, a capacitor charging circuit that charges the ignition capacitor Ci with one polarity with the positive half cycle of the output voltage of the exciter coil is comprised of a closed circuit of the exciter coil 2—the charging diode D4—the ignition capacitor Ci—the primary coil 1*a*—the first feedback diode D1—the second feedback diode D2—the exciter coil 2.

In the shown example, a diode D5 with its anode directed to the ground is connected across the thyristor Th in order to pass a current for recharging the capacitor Ci with a voltage induced in the primary coil 1*a* when the thyristor Th conducts to discharge the charges in the ignition capacitor Ci through the thyristor Th and the primary coil of the ignition coil to increase duration of a discharge current.

In order to control a crank angle position (an ignition position) where the trigger signal is provided to the thyristor Th, a trigger power supply capacitor Ct having one end grounded is provided, and the other end of the capacitor (an ungrounded terminal) is connected to one end 2*a* of the exciter coil 2 through a backflow inhibiting diode D6 with its anode directed to the exciter coil 2 and through a charging time constant adjusting resistor R2.

The ungrounded terminal of the trigger power supply capacitor Ct is connected to one end of a differential capacitor Cd through a discharging resistor R3, and the other end of the differential capacitor Cd is connected to the gate of the thyristor Th through a trigger signal providing diode D7 with its anode directed to the differential capacitor. A Zener diode ZD1 with its anode directed to the ground is connected across the trigger power supply capacitor Ct, and a diode D8 with its anode directed to the ground is connected between the anode of the diode D7 and the ground. A collector of an NPN transistor TR1 whose emitter is grounded is connected to a connect between the differential capacitor Cd and the resistor R3, and a resistor R4 is connected between a base of the transistor TR1 and one end 2*a* of the exciter coil 2.

In the shown example, the thyristor trigger circuit 10 is comprised of the capacitors Ct and Cd, the resistors R2 to R4, the diodes D6 to D8, the Zener diode ZD1, and the transistor TR1. In this thyristor trigger circuit, a charging time constant determined from the sum of a resistance value of the charging time constant adjusting resistor R2 and a resistance value of the resistor R1 connected in series with the third feedback diode D3 and capacitance of the trigger power supply capacitor Ct, and a discharging time constant determined from capacitance of the trigger power supply capacitor Ct and a resistance value of the discharging resistor R3 are set to values appropriate for charges required for providing the trigger signal to the thyristor Th to remain in the trigger power supply capacitor Ct.

The ignition unit 3 is comprised of the thyristor trigger circuit 10, the ignition capacitor Ci, the diodes D1 to D5, and the resistor R1. The capacitor discharge ignition device for an internal combustion engine is comprised of the ignition coil 1, the exciter coil 2, and the ignition unit 3, and an ungrounded terminal of the secondary coil 1*b* of the ignition coil is connected through a high pressure cord to an ungrounded terminal of an ignition plug 11 mounted to the cylinder of the engine.

In the ignition device in FIG. 1, a reverse bias circuit is comprised of the first feedback diode D1, which applies a reverse bias voltage between the gate and the cathode of the thyristor Th when a current flowing from the exciter coil 2 through between the anode and the cathode of the thyristor Th is detected and when a charging current of the ignition capacitor Ci is detected, and a trigger inhibiting circuit is comprised of the reverse bias circuit, which inhibits the thyristor Th from being triggered when the current flowing from the exciter coil 2 through between the anode and the cathode of the thyristor Th is detected and when the charging current of the ignition capacitor Ci is detected.

In order to stop the internal combustion engine, a stop switch 12 is connected between the other end 2*b* of the exciter coil 2 and the ground, and when the stop switch 12 is closed, the positive half cycle of the output voltage of the exciter coil 2 is short-circuited through the stop switch and the diodes D1 and D2 to stop an ignition operation of the ignition device.

In the shown example, a series circuit of a detection switch 13, a light emitting diode LD as warning indication means, and a backflow inhibiting diode D9 in the same direction as the light emitting diode LD is connected between the other end 2*b* of the exciter coil 2 and the ground with an anode of the light emitting diode LD directed to the ground. The light emitting diode LD is provided so that a voltage drop that occurs across the resistor R1 when the exciter coil 2 generates the negative half cycle of the output voltage is applied forward through the detection switch 13.

The detection switch 13 is a switch that is turned on when a state where warning indication is required occurs, such as a state where an amount of lubricant oil remaining in the engine reaches below an allowable lower limit, a state where pressure of the lubricant oil reaches below an allowable lower limit, or a state where an amount of fuel remaining in the engine reaches below an allowable lower limit.

In the ignition device in FIG. 1, the resistance value of the resistor R1 is set so that a voltage equal to or higher than a value required for the light emitting diode LD to emit light occurs across the series circuit of the resistor R1 and the third feedback diode D3 while the exciter coil 2 is generating the negative half cycle of the output voltage.

The operation of the ignition device in FIG. 1 is as described below.

When the crankshaft of the internal combustion engine rotates, and the exciter coil 2 generates the positive half cycle of the output voltage Vp at a crank angle position 02 as shown in FIG. 3A, a current flows through a path of the exciter coil 2—the ignition capacitor Ci—the primary coil 1*a* of the ignition coil—the first feedback diode D1—the second feedback diode D2—the exciter coil 2, and the ignition capacitor Ci is charged with the shown polarity. Thus, a voltage Vc across the ignition capacitor Ci increases as shown in FIG. 3B.

Then, when the exciter coil 2 generates the negative half cycle of the output voltage Vn2 at a crank angle position θ4, a base current flows through the transistor TR1 to turn on the transistor TR1. At this time, a charging current flows from the exciter coil 2 to the trigger power supply capacitor Ct through the backflow inhibiting diode D6, the charging time constant adjusting resistor R2, the resistor R1, and the third feedback diode D3, and the trigger power supply capacitor Ct is charged at a certain charging time constant. The charges stored in the capacitor Ct are discharged at a certain discharging time constant through the resistor R3 and between the collector and the emitter of the transistor TR1.

When an instantaneous value of the negative half cycle of the output voltage Vn2 of the exciter coil 2 reaches below a predetermined threshold level Vt at a crank angle position θi, the transistor TRI is turned off. Thus, the charges remaining in the trigger power supply capacitor Ct are discharged through the resistor R3, the differential capacitor Cd, the diode D7, and between the gate and the cathode of the thyristor Th, and a trigger signal current Ig having a waveform shown in FIG. 3C flows through the thyristor Th to apply a trigger signal voltage Vgk having a waveform shown in FIG. 3D is applied between the gate and the cathode of the thyristor Th until charging of the differential capacitor Cd is completed. This causes the thyristor Th to conduct, and the charges in the ignition capacitor Ci are discharged through the thyristor Th and the primary coil 1*a* of the ignition coil. The discharge of the ignition capacitor causes a current with a steep rise to flow through the primary coil 1*a* of the ignition coil, and causes a large change in magnetic flux in the core of the ignition coil, thus inducing a high voltage for ignition in the secondary coil 1*b*. The high voltage for ignition is applied to the ignition plug 11 to cause spark discharge at the ignition plug and ignite the engine. Specifically, in the ignition unit, the position where the instantaneous value of the negative half cycle of the output voltage Vn2 of the exciter coil 2 reaches below the predetermined threshold level Vt to turn off the transistor TR1 is the ignition position of the engine (the crank angle position when the ignition operation is performed).

The trigger signal current Ig is provided to the thyristor Th also when the first negative half cycle of the output voltage Vn1 first generated by the exciter coil 2 reaches below the threshold level Vt at a crank angle position θ1, but the ignition capacitor Ci has not yet been charged at this time, and thus no ignition operation is performed.

When a sufficient space is provided between the magnetic poles m1 and m2 of the magnetic rotor, and a sufficiently large angle can be made between the crank angle position θ1 where the first negative half cycle of the output voltage Vn1 reaches below the threshold level Vt and the crank angle position θ2 where the exciter coil generates the positive half cycle of the output voltage Vp, the trigger signal current Ig is eliminated before the position θ2 where the positive half cycle of the output voltage Vp of the exciter coil rises even during the high speed rotation of the engine, thus the positive half cycle of the output voltage Vp of the exciter coil does not rise with the trigger signal provided to the thyristor Th, and the thyristor does not conduct when the positive half cycle of the output voltage of the exciter coil rises.

On the other hand, when the space between the magnetic poles m1 and m2 of the magnet rotor is narrowed, and a smaller angle is made between the crank angle position θ1 where the first negative half cycle of the output voltage Vn1 reaches below the threshold level Vt and the crank angle position θ2 where the exciter coil generates the positive half cycle of the output voltage Vp because of the rotor having a smaller diameter, or the like, a time required for the crankshaft to rotate from the position θ1 to the position θ2 during the high speed rotation of the engine may become shorter than a time ΔT when the trigger signal current Ig is provided to the thyristor.

When such a state occurs, the positive half cycle of the output voltage Vp of the exciter coil 2 rises with the trigger signal provided to the thyristor Th at the crank angle position θ2, and is applied forward between the anode and the cathode of the thyristor Th, thus causing the thyristor Th to conduct to short-circuit the exciter coil. Thus, when the thyristor Th conducts to short-circuit the exciter coil when the exciter coil generates the positive half cycle of the output voltage, the charging of the ignition capacitor Ci is prevented to cause no ignition operation at the crank angle position (a normal ignition position) θi and cause misfire of the engine.

In the invention, in order to prevent occurrence of such a state, the trigger inhibiting circuit is provided that inhibits the thyristor Th from being triggered when the current flowing from the exciter coil 2 through between the anode and the cathode of the thyristor Th is detected and when the charging current of the ignition capacitor Ci is detected. In the shown example, the trigger inhibiting circuit is comprised of the reverse bias circuit that applies the reverse bias voltage between the gate and the cathode of the thyristor Th when the current flowing from the exciter coil 2 through between the anode and the cathode of the thyristor Th is detected and when the charging current of the ignition capacitor Ci is detected.

As described above, in this embodiment, the reverse bias circuit is comprised of the first feedback diode D1. As shown in FIG. 1, if the first feedback diode D1 is connected between the gate and the cathode of the thyristor Th, the positive half cycle of the output voltage Vp of the exciter coil rises with the trigger signal current Ig flowing at the crank angle position θ2 and an anode current starts to flow through the thyristor Th, and when the thyristor is about to move to a conducting state, a current flows through the first feedback diode D1 through a path of the exciter coil 2—the diode D4—between the anode and the cathode of the thyristor Th—the diode D1—the diode D2—the exciter coil 2 to cause a forward voltage drop across the diode D1. As shown in FIG. 3D, the voltage drop causes the reverse bias voltage Vgk to be applied between the gate and the cathode of the thyristor. When the thyristor Th about to move to the conducting state is reverse biased between the gate and the cathode, the thyristor Th cannot move to the conducting state and returns to a blocking state, thus allowing the ignition capacitor Ci to be charged from the exciter coil 2 through the charging circuit without a hitch. The charging current of the capacitor flows through the first feedback diode D1, and thus the reverse bias voltage is continuously applied between the gate and the cathode of the thyristor Th while the charging current of the ignition capacitor is flowing. Thus, the thyristor Th is kept in a reverse biased state between the gate and the cathode while the ignition capacitor Ci is charged, and the ignition capacitor is stably charged without the thyristor Th being accidentally triggered by noises or the like.

When the trigger signal is provided to the thyristor Th at the normal ignition position θ2, the discharge current of the ignition capacitor Ci flows through the thyristor Th and the primary coil 1*a* of the ignition coil, and no current flows through the feedback diode D1, thus allowing the thyristor to be triggered without a hitch.

In the ignition device in FIG. 1, when a state where warning indication is required occurs to turn on the detection switch 13 with the engine rotating, a current flows through a path of the exciter coil 2—the diode D6—the resistor R2—the capacitor Ct—the resistor R1—the diode D3—the exciter coil 2 and a path of the exciter coil 2—the diode D6—the resistor R2—the resistor R3—between the collector and the emitter of the transistor TR1—the resistor R1—the diode D3—the exciter coil 2, thus causing a voltage drop across the resistor R1, which is applied forward to the light emitting diode LD through the detection switch 13. Thus, the light emitting diode LD emits light to perform warning indication of such as insufficient lubricant oil or insufficient pressure of the lubricant oil.

In the example in FIG. 1, the light emitting diode LD performs the warning indication, but the invention may be, of course, applied to cases without such warning indication means.

When no light emitting diode LD is provided in the example in FIG. 1, the resistor R1 connected in series with the third feedback diode D3 may be omitted to directly ground the anode of the diode D3.

When the reverse bias circuit that applies the reverse bias voltage between the gate and the cathode of the thyristor Th is provided, and the trigger inhibiting circuit that inhibits the thyristor Th from being accidentally triggered is comprised of the reverse bias circuit as in the example in FIG. 1, the construction of the reverse bias circuit is not limited to the above described example, and for example, the first feedback diode D1 may be replaced with a resistor with a smaller resistance value to reverse bias the thyristor Th between the gate and the cathode by a voltage drop across the resistor when a feedback current flows.

Second Embodiment

Figure 4:
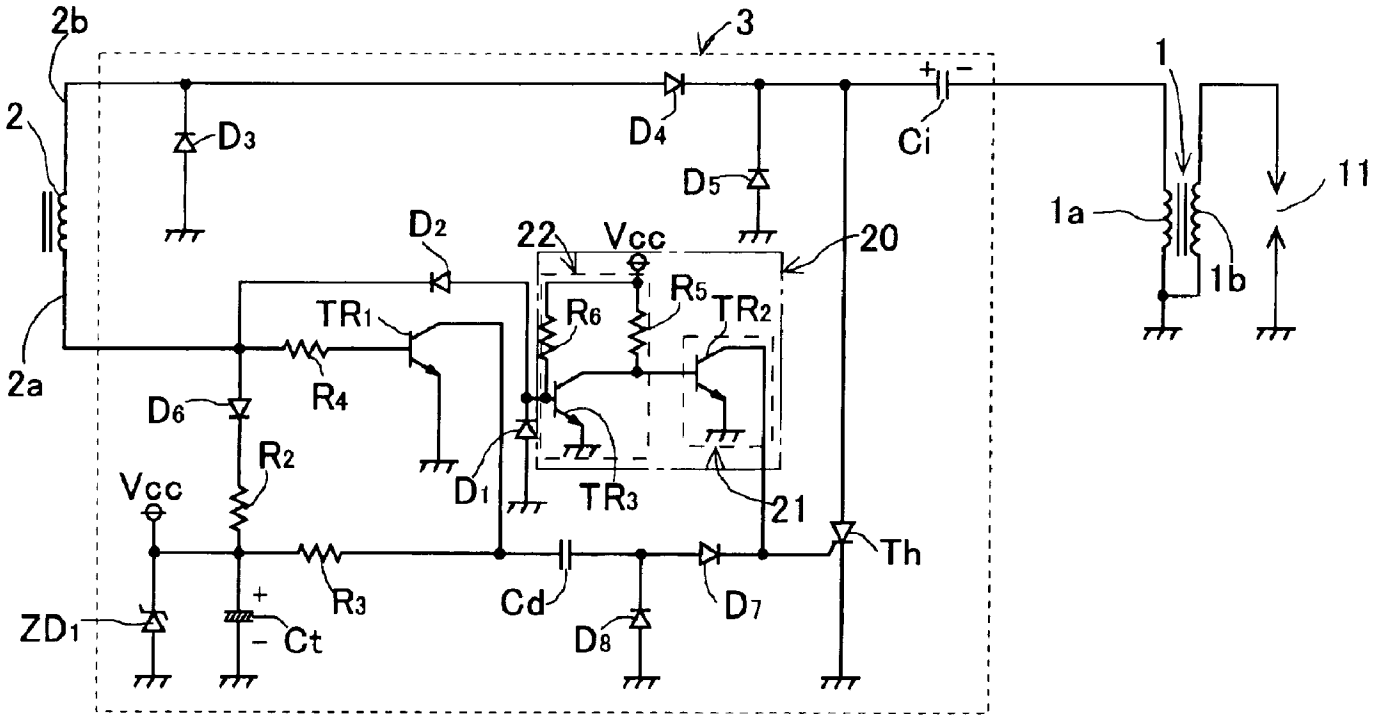
FIG. 4 is a circuit diagram of a construction of a second embodiment according to the invention.

FIG. 4 shows a second embodiment of the invention. In the embodiment, instead of the reverse bias circuit provided in the embodiment in FIG. 1, a short circuit 20 is provided that short-circuits a thyristor Th between a gate and a cathode when a current flowing from an exciter coil 2 through between an anode and a cathode of the thyristor Th is detected and when a charging current of an ignition capacitor Ci is detected, and a trigger inhibiting circuit is comprised of the short circuit.

In the example in FIG. 4, a positive current feedback circuit that constructs a return circuit of a current flowing out of the exciter coil when the exciter coil 2 generates a positive half cycle of an output voltage Vp is comprised of a first feedback diode D1 whose anode is grounded, and a second feedback diode D2 connected between a cathode of the first feedback diode D1 and one end 2*a* of the exciter coil 2 with its anode directed to the cathode of the first feedback diode D1. A negative current feedback circuit that constructs a return circuit of a current flowing out of the exciter coil when the exciter coil 2 generates negative half cycles of output voltages Vn1 and Vn2 is comprised of a third feedback diode D3 connected between the other end 2*b* of the exciter coil 2 and the ground with its anode directed to the ground.

In the example in FIG. 4, the short circuit 20 is comprised of a short-circuiting switch 21 provided so as to short-circuit the thyristor Th between the gate and the cathode when the thyristor Th conducts, and a short-circuiting switch drive circuit 22 that causes the short-circuiting switch to conduct when a current flowing from the exciter coil 2 through between the anode and the cathode of the thyristor Th is detected and when a charging current of the ignition capacitor Ci is detected. In this case, the short-circuiting switch drive circuit 22 is preferably comprised so as to cause the short-circuiting switch 21 to conduct when a forward voltage drop occurring across the first feedback diode D1 is detected.

The shown short-circuiting switch 21 includes an NPN transistor TR2 whose collector and emitter are connected to the gate and the cathode of the thyristor Th, respectively. The short-circuiting switch drive circuit 22 is comprised of an NPN transistor TR3 whose collector and emitter are connected to a base and the emitter of the transistor TR2, and resistors R5 and R6 that are connected between an ungrounded terminal of a capacitor Ct and the base of the transistor TR2 and between the ungrounded terminal of the capacitor Ct and a base of the transistor TR3, respectively to form a circuit that provides a base current to the transistors TR2 and TR3, and a voltage across the first feedback diode D1 is applied between the base and the emitter of the transistor TR3.

Other constructions are similar to those in the example in FIG. 1. FIG. 4 shows no stop switch, but when a stop switch is used to stop the engine, the stop switch is connected between the other end 2*b* of the exciter coil 2 and the ground as in the example in FIG. 1.

In the example in FIG. 4, when no current flows through the feedback diode D1, a base current is provided to the transistor TR3 at a voltage Vcc across the trigger power supply capacitor Ct, and thus the transistor TR3 is in an ON state and the transistor TR2 is in an OFF state.

When the exciter coil 2 generates the positive half cycle of the output voltage Vp with a trigger signal current provided to the thyristor Th at a crank angle position θ2, an anode current starts to flow through the thyristor Th and the thyristor is about to move to a conducting state. However, a current flows through the first feedback diode D1 at the same time as the anode current starts to flow through the thyristor Th, and a forward voltage drop occurring across the diode D1 is applied between the base and the emitter of the transistor TR3 in a reverse direction to turn off the transistor TR3 and turn on the transistor TR2. This causes the thyristor Th to be short-circuited between the gate and the cathode, thus inhibiting the thyristor Th from moving to the conducting state and causing the thyristor to return to a blocking state. Therefore, ignition capacitor Ci is charged to perform an ignition operation without a hitch.

The thyristor trigger circuit used in each of the above described embodiments may be a circuit that provides a trigger signal to a thyristor by a negative half cycle of an output voltage of an exciter coil, and the construction thereof is not limited to those shown in the embodiments.

As in the embodiments, in the case where the thyristor trigger circuit 10 is comprised so that the trigger signal is provided to the thyristor Th through the differential capacitor Cd by the charges remaining in the trigger power supply capacitor Ct when the negative half cycle of the output voltage generated by the exciter coil 2 peaks and then reaches below the threshold level to turn off the trigger controlling transistor TR1, the ignition position of the engine is determined at a substantially fixed position. If a thyristor trigger circuit is comprised so that a trigger signal is provided to the thyristor Th when a negative half cycle of an exciter coil reaches a set level, an ignition position can be advanced as a peak value of the negative half cycle of the output voltage of the exciter coil increases with increase in rotational speed of an engine, but an advanced width is at most an angle between a rising position of the negative half cycle of the output voltage and a peak position, and cannot be enlarged. In order to enlarge the advanced width of the ignition position to control the ignition position with respect to the rotational speed of the engine, it is necessary to determine an ignition position by arithmetical operation and to provide a trigger signal to a thyristor at the arithmetically operated ignition position, as in a third embodiment described below.

Third Embodiment

Figure 5:
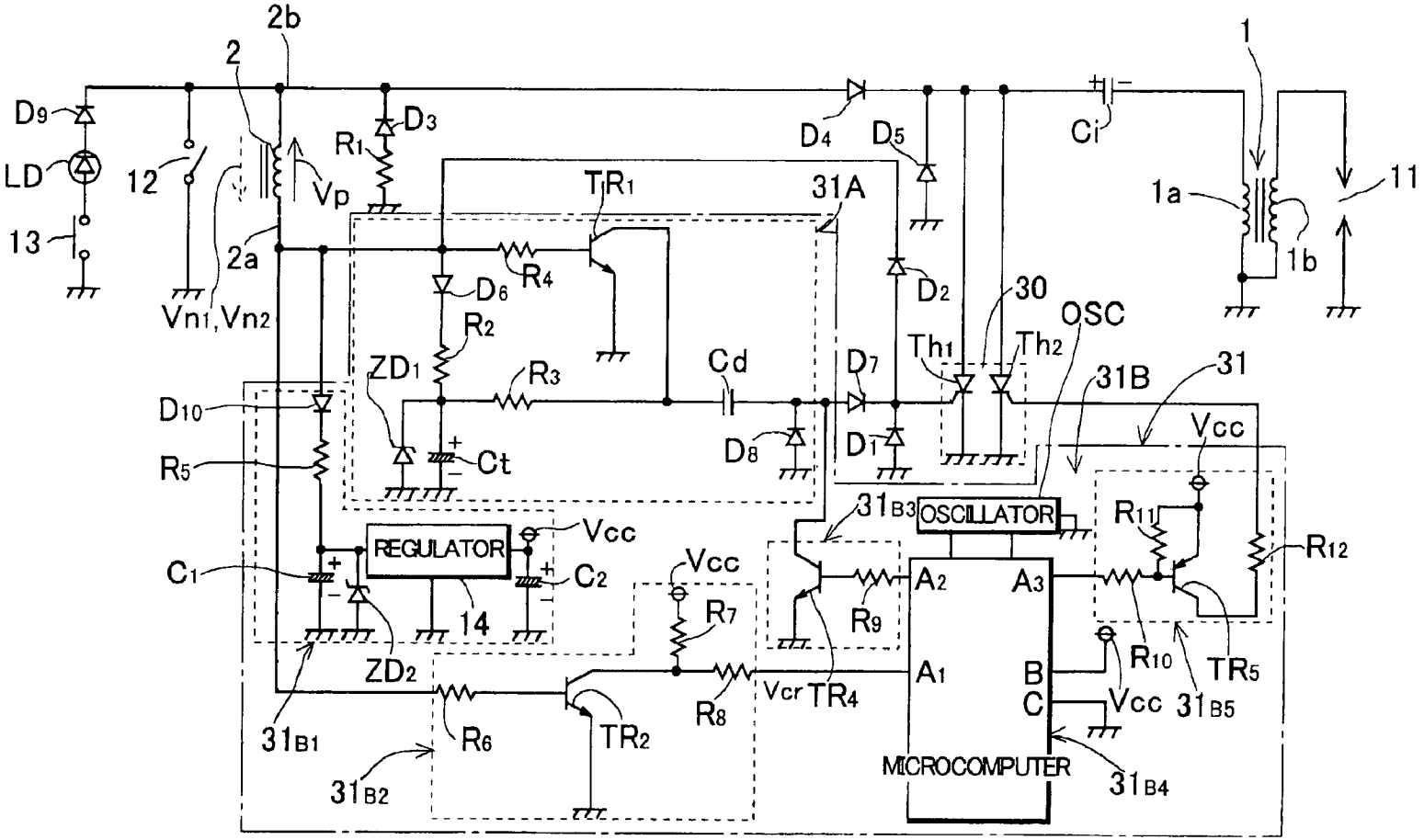
FIG. 5 is a circuit diagram of a construction of a third embodiment according to the invention.

FIG. 5 shows a construction of hardware of the third embodiment of the invention, and in FIG. 5, like reference numerals denote like parts as in the embodiment in FIG. 1. In the embodiment in FIG. 5, there are provided a discharging switch circuit 30 that is comprised so as to have a first thyristor Th1 and a second thyristor Th2, and discharge charges stored in an ignition capacitor Ci through a primary coil 1*a* of an ignition coil when either the first thyristor or the second thyristor is turned on, and a thyristor trigger circuit 31 that provides a trigger signal to either the first thyristor Th1 or the second thyristor Th2 at an ignition position in an internal combustion engine using a negative half cycle of an output voltage of an exciter coil 2 as a power supply voltage.

The shown discharging switch circuit 30 is comprised of the first thyristor Th1 connected between a terminal of the ignition capacitor Ci on the side of the exciter coil and the ground with its cathode directed to the ground, and the second thyristor Th2 connected across the first thyristor Th1 in parallel with its cathode directed to the ground.

The thyristor trigger circuit 31 is comprised of a first trigger circuit 31A that provides a trigger signal to the first thyristor Th1 using the exciter coil as a signal source while the exciter coil 2 is generating the negative half cycle of the output voltage, and a second trigger circuit 31B that detects a rotational speed of the internal combustion engine from the output of the exciter coil 2 and provides a trigger signal to the second thyristor Th2 at an ignition position arithmetically operated with respect to the detected rotational speed.

The first trigger circuit 31A is comprised of a trigger power supply capacitor Ct, a differential capacitor Cd, diodes D6 and D8, a Zener diode Zd1, resistors R2 to R4, and a transistor TR1, similarly to the thyristor trigger circuit 10 in FIG. 1.

In this embodiment, a positive current feedback circuit that constructs a return circuit of a current flowing out of the exciter coil when the exciter coil 2 outputs a positive half cycle of an output voltage Vp is comprised of a first feedback diode D1 connected between a gate and a cathode of the first thyristor Th1 with its anode directed to the ground, and a second feedback diode D2 connected between the gate of the thyristor Th1 and one end 2*a* of the exciter coil 2 with its anode directed to the gate of the thyristor Th1.

Also, a third feedback diode D3 with its anode directed to the ground is provided between the other end 2*b* of the exciter coil 2 and the ground, and a negative current feedback circuit that constructs a return circuit of a current flowing out of the exciter coil when the exciter coil 2 outputs negative half cycles of output voltages Vn1 and Vn2 is comprised of the third feedback diode D3. Also in this embodiment, a resistor R1 as a current limiting element is inserted between the anode of the third feedback diode D3 and the ground.

In this embodiment, a reverse bias circuit is comprised of the first feedback diode D1 connected between the gate and the cathode of the first thyristor Th1, which applies a reverse bias voltage between the gate and the cathode of the first thyristor Th1 when a current flowing from the exciter coil 2 through between the anode and the cathode of the first thyristor Th1 is detected and when a charging current of the ignition capacitor Ci is detected, and a trigger inhibiting circuit is comprised of the reverse bias circuit, which inhibits the first thyristor Th1 from being triggered when the current flowing from the exciter coil 2 through between the anode and the cathode of the first thyristor Th1 is detected and when the charging current of the ignition capacitor Ci is detected.

In order to stop the internal combustion engine, a stop switch 12 is connected between the other end 2*b* of the exciter coil 2 and the ground.

Further, a series circuit of a detection switch 13, a light emitting diode LD as warning indication means, and a backflow inhibiting diode D9 in the same direction as the light emitting diode LD is connected between the other end 2*b* of the exciter coil 2 and the ground with an anode of the light emitting diode LD directed to the ground.

The second trigger circuit 31B is comprised of a power supply circuit 31B1 that uses the negative half cycle of the output voltage of the exciter coil 2 as an input to output a fixed DC voltage, a crank angle detection signal generation circuit 31B2 that generates a crank angle detection signal Vcr when the negative half cycle of the output voltage of the exciter coil 2 reaches a certain value, a trigger signal bypassing switch 31B3 provided so as to bypass from the first thyristor the trigger signal provided from the first trigger circuit 31A to the first thyristor Th1 in an ON state, a microcomputer 31B4 that is provided so as to operate using the crank angle detection signal as an input and the output voltage of the power supply circuit 31B1 as a power supply voltage, and executes a program for constructing various means required for triggering the second thyristor Th2 and means for driving the trigger signal bypassing switch 31B3, and a trigger signal output circuit 31B5 that outputs a trigger signal to be provided to the second thyristor Th2 when the microcomputer issues a trigger instruction. A fixed clock pulse is provided from an oscillator OSC to the microcomputer 31B4.

Figure 6:
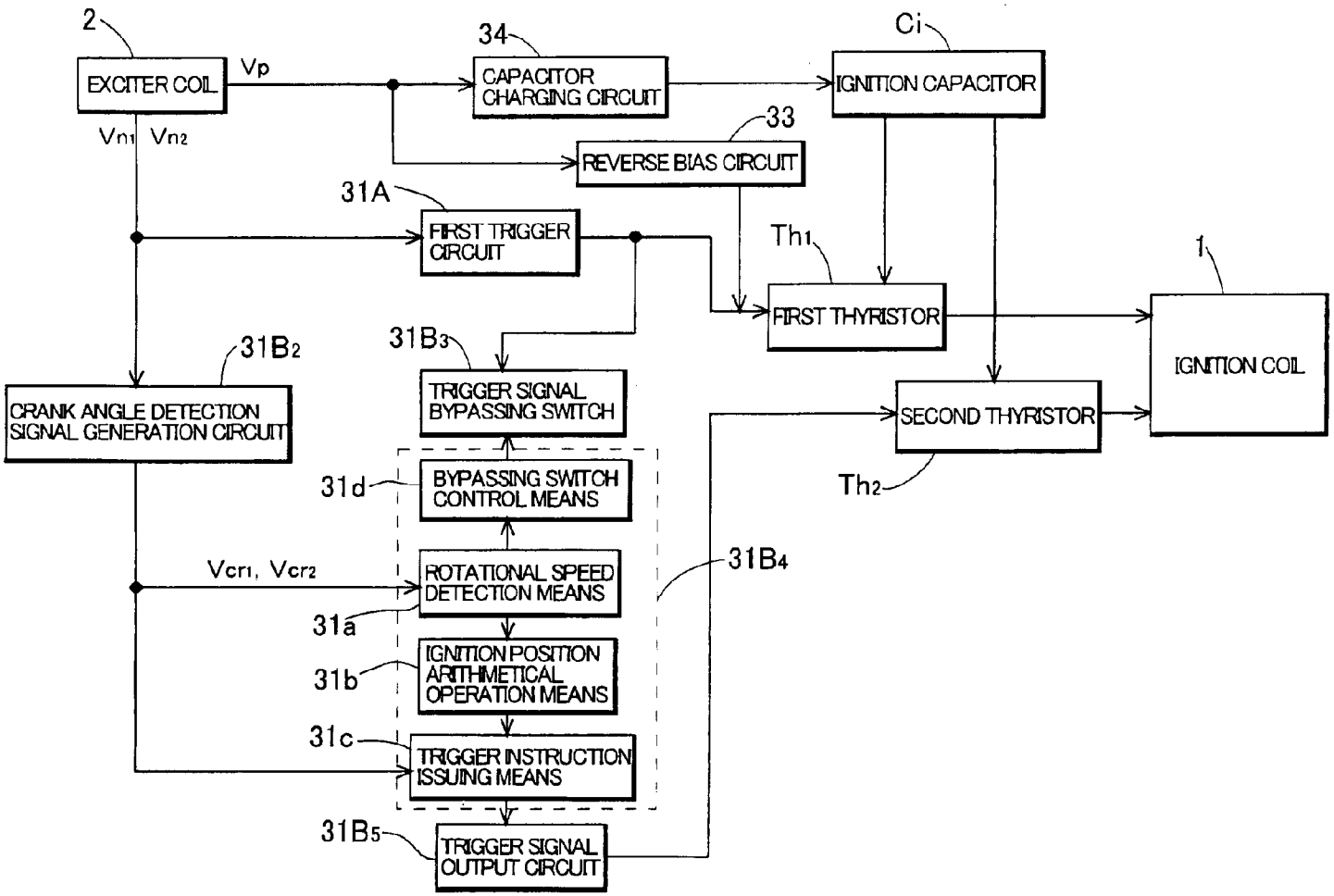
FIG. 6 is a block diagram of an entire construction of the embodiment in FIG. 5.

FIG. 6 shows a construction of the embodiment in FIG. 5 including various means constructed by the microcomputer 31B4. In FIG. 6, 33 denotes a reverse bias circuit comprised of the diode D1, and 34 denotes a capacitor charging circuit comprised of a closed circuit of the exciter coil 2—a charging diode D4—the ignition capacitor Ci—the primary coil 1*a*—the diode D1—the diode D2—the exciter coil 2.

The microcomputer 31B4 is operated when a predetermined power supply voltage is provided between a power supply terminal B and a ground terminal C from the power supply circuit 31B1 to execute a predetermined program stored in a nonvolatile memory such as a ROM or an EEPROM, and thus constructs rotational speed detection means 31*a* that uses the crank angle detection signal Vcr generated when the first negative half cycle of the output voltage Vn1 output by the exciter coil reaches a certain value as a reference signal to detect a rotational speed of the internal combustion engine from a production interval of the reference signal (a time required for one rotation of a crankshaft), ignition position arithmetical operation means 31*b* that arithmetically operates an ignition position of the internal combustion engine with respect to the rotational speed detected by the rotational speed detection means, trigger instruction issuing means 31*c* that issues a trigger instruction when the ignition position arithmetically operated by the ignition position arithmetical operation means is detected, and bypassing switch control means 31*d* that keeps the trigger signal bypassing switch 31B3 in an OFF state when the rotational speed of the internal combustion engine is below a set value, and keeps the trigger signal bypassing switch 31B3 in an ON state when the rotational speed of the internal combustion engine exceeds the set value.

More specifically, the shown power supply circuit 31B1 is comprised of a diode D10 whose anode is connected to one end 2*a* of the exciter coil 2, a capacitor C1 connected between a cathode of the diode D10 and the ground through a resistor R5, a Zener diode ZD2 connected across the capacitor C1 in parallel, and a regulator 14 that regulates a voltage across the capacitor C1 so as to be kept at a set value, and a capacitor C2 connected between output terminals of the regulator 14, and outputs a fixed (for example, 5V) DC voltage Vcc across the capacitor C2.

The crank angle detection signal generation circuit 31B2 is comprised of an NPN transistor TR2 whose base is connected to one end 2*a* of the exciter coil 2 through a resistor R6 and whose emitter is grounded, a resistor R7 connected between a collector of the transistor TR2 and an ungrounded output terminal of the power supply circuit 31B1, and a resistor R8 connected at its one end to the collector of the transistor TR2, and the other end of the resistor R8 is connected to a port A1 of the microcomputer 31B4.

The trigger signal bypassing switch 31B3 is comprised of an NPN transistor TR4 whose emitter is grounded and whose base is connected to a port A2 of the microcomputer through a resistor R9, and a collector of the transistor TR4 is connected to an anode of a diode D7. When the transistor TR4 is in an OFF state, a trigger signal output by the first trigger circuit 31A is allowed to be provided to the first thyristor Th1, and when the transistor TR4 is in an ON state, the trigger signal output by the first trigger circuit 31A is bypassed from the thyristor Th1 to prevent the trigger signal from being provided to the thyristor Th1.

The trigger instruction output circuit 31B5 is comprised of a PNP transistor TR5 whose base is connected to a port A3 of the microcomputer through a resistor R10 and whose emitter is connected to an output terminal of the power supply circuit 31B1, a resistor R11 connected between the emitter and the base of the transistor TR5, and a resistor R12 connected at its one end to a collector of the transistor TR5, and the other end of the resistor R12 is connected to a gate of the thyristor Th2.

Figures 7A, 7B, 7C, 7D, 7E, 7F, 7G:
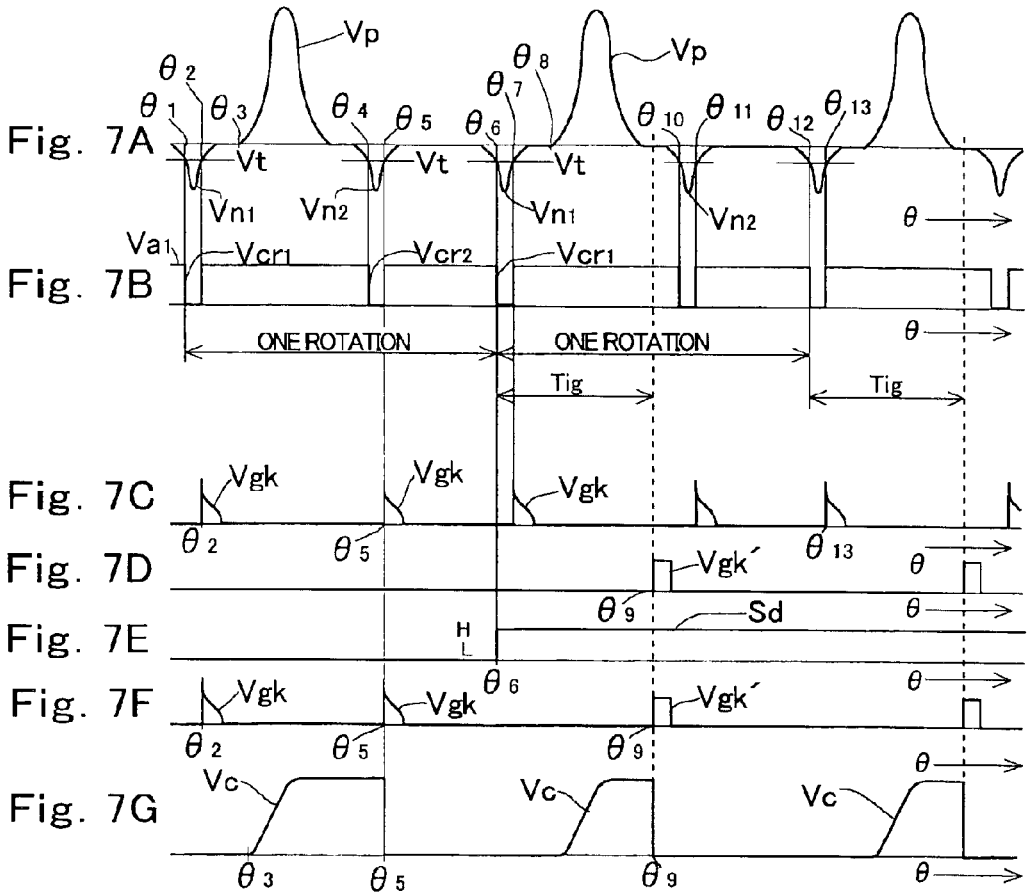
FIGS. 7A to 7G show voltage waveforms of different parts of the embodiment in FIG. 5.

FIGS. 7A to 7G show voltage waveforms of different parts of the ignition device in FIG. 5. FIG. 7A shows an output voltage waveform of the exciter coil 2, and FIG. 7B shows a waveform of potential Va1 of the port A1 of the microcomputer. FIG. 7C shows a waveform of a trigger signal Vgk output by the first trigger circuit, and FIG. 7D shows a waveform of a trigger signal Vgk' provided from the trigger signal output circuit 31B5 to the gate of the second thyristor Th2. Further, FIG. 7E shows a bypassing switch driving signal Sd output from the port A2 of the microcomputer, and FIG. 7F shows a waveform of a series of trigger signals finally provided to the discharging switch circuit 30. FIG. 7G shows a waveform of the voltage Vc across the ignition capacitor Ci.

In the ignition device in FIG. 5, the transistor TR2 of the crank angle detection signal generation circuit is turned on when the negative half cycle of the output voltage of the exciter coil 2 reaches the threshold level or higher to set potential of the collector to a low level (L level), and turned off when the negative half cycle of the output voltage of the exciter coil 2 reaches below the threshold level to set the potential of the collector to a high level (H level).

The microcomputer 31B4 recognize a reduction in potential of the collector of the transistor TR2 as a crank angle detection signal. As shown in FIG. 7B, a crank angle detection signal generated when the first negative half cycle of the output voltage Vn1 of the exciter coil reaches a threshold level Vt is a first crank angle detection signal Vcr1, and a crank angle detection signal generated when the second negative half cycle of the output voltage Vn2 of the exciter coil reaches the threshold level Vt is a second crank angle detection signal Vcr2.

The microcomputer uses a difference between a time from when the first crank angle detection signal Vcr1 on an advanced side is generated to when the second crank angle detection signal Vcr2 on a delayed side is generated, and a time from when the second crank angle detection signal Vcr2 is generated to when a next first crank angle detection signal Vcr1 is generated, to distinguish the first crank angle detection signal Vcr1 from the second crank angle detection signal Vcr2 and recognize the first crank angle detection signal Vcr1 on the advanced side as a reference signal.

The rotational speed detection means 31*a* constructed by the microcomputer reads a measurement value of a timer that counts a clock pulse every time the first crank angle detection signal Vcr1 (the reference signal) is generated, thus calculates a time measured between when the last reference signal is generated and when the present reference signal is generated (a time required for one rotation of the crankshaft) as time data Tn for one rotation, and a rotational speed NE=60(1/Tn) [rpm] is arithmetically operated from the time data Tn.

The ignition position arithmetical operation means 31*b* searches an ignition position arithmetical operation map (stored in a ROM or an EEPROM) that provides a relationship between a rotational speed of the internal combustion engine and an ignition position with respect to the rotational speed detected by the rotational speed detection means, and arithmetically operates an ignition position at each rotational speed by a value read from the map being subjected to an interpolation operation. The ignition position is arithmetically operated, for example, as an angle measured from a crank angle position (top dead center position) when a piston of the engine reaches the top dead center toward the advanced side.

The ignition position arithmetical operation means also performs an arithmetically operation such that the arithmetically operated ignition position is converted to a time (ignition timer clocking data) Tig measured by an ignition timer during a rotation of the engine from a production position of the reference signal (the first crank angle detection signal Vcr1) to the ignition position. The ignition timer clocking data Tig is arithmetically operated by the following equation:

$$Tig=Tn(\theta ref-\theta ig)/360 \quad (1)$$

where an angle of the crank angle position (an angle measured from the top dead center position) produced by the reference signal is θref, and the ignition position is θig.

The trigger instruction issuing means 31*c* sets the ignition timer clocking data Tig in the ignition timer to start the measurement when the reference signal is generated, and reduces potential of the port A3 of the microcomputer to the L level when the ignition timer completes the measurement of the ignition timer clocking data Tig to issue a trigger instruction.

When the potential of the port A3 of the microcomputer is set to the L level to issue the trigger instruction, the transistor TR5 of the trigger signal output circuit 31B5 is turned on, and thus a trigger signal Vgk' is provided from the power supply circuit 31B1 to the gate of the second thyristor Th2 through the emitter and the collector of the transistor TR5 and the resistor R12.

When the rotational speed N of the internal combustion engine detected by the rotational speed detection means is a set value Ns or lower, the bypassing switch control means 31*d* sets potential Sd of the port A2 of the microcomputer to the L level as shown in FIG. 7E to keep the transistor TR4 (the trigger signal bypassing switch) in an OFF state, and when the rotational speed N exceeds the set value Ns, the bypassing switch control means 31*d* sets the potential of the port A2 to the H level to turn on the transistor TR4 (the trigger signal bypassing switch) to enter the ON state. The transistor TR4 is kept in the ON state while the rotational speed N of the internal combustion engine exceeds the set value Ns.

Figure 8:
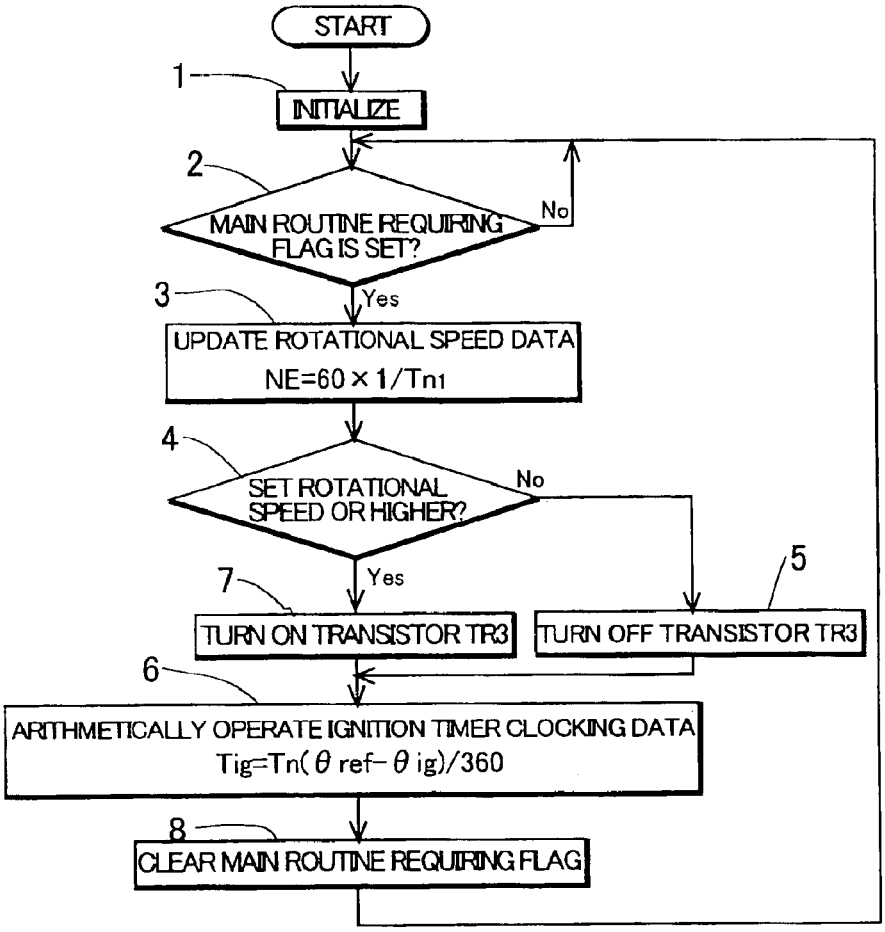
FIG. 8 is a flowchart describing an algorithm of a main routine of a program executed by a microcomputer in the embodiment in FIGS. 5 and 6.
Figure 9:
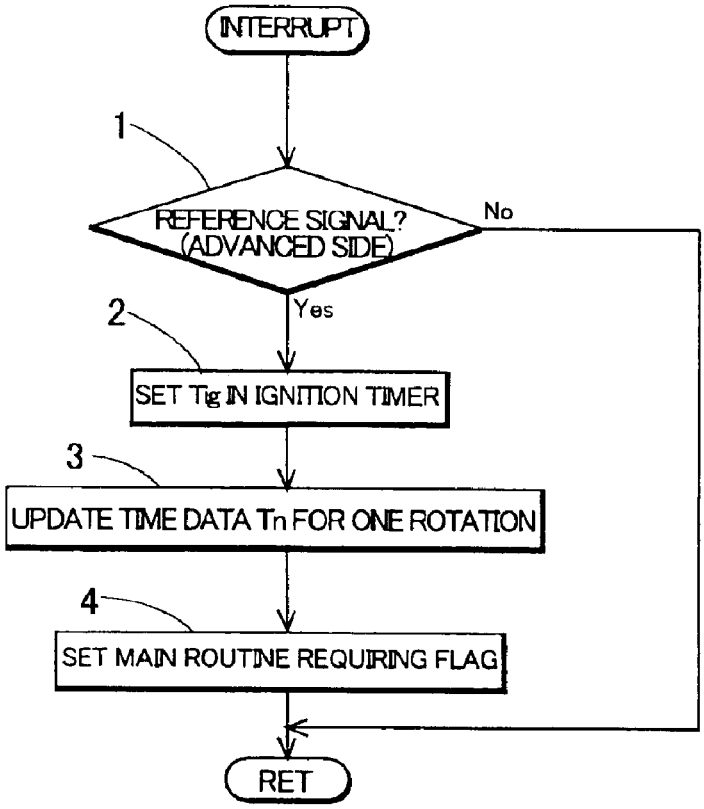
FIG. 9 is a flowchart describing an algorithm of an interruption routine executed by the microcomputer every time a crank angle detection signal is generated in the embodiment in FIGS. 5 and 6.

FIGS. 8 and 9 show flowcharts of algorithms of the program executed by the microcomputer to construct the rotational speed detection means 31*a*, the ignition position arithmetical operation means 31*b*, the trigger instruction issuing means 31*c*, and the bypassing switch control means 31*d*. FIG. 8 shows a main routine, and FIG. 9 shows an interruption routine executed every time the crank angle detection signal generation circuit 31B2 generates the crank angle detection signals Vcr1 and Vcr2.

When a power supply voltage is provided to the microcomputer 31B4 and the microcomputer is operated, Step 1 in FIG. 8 is first performed to initialize each part, and then in Step 2, it is determined whether a flag (a main routine requiring flag) that requires execution of the main routine is set. When it is determined that the main routine requiring flag is not set, the flag being set is waited. When the main routine requiring flag is set in a final step of the interruption routine in FIG. 9, Step 3 in FIG. 8 is performed to arithmetically operate the rotational speed NE by using the time data Tn for one rotation of the crankshaft fetched in the interruption routine in FIG. 9, and update rotational speed data.

Then, the process proceeds to Step 4, and it is determined whether the arithmetically operated rotational speed is a set rotational speed or higher. When it is determined that the rotational speed is not the set rotational speed or higher, the process proceeds to Step 5 to set the potential of the port A2 of the microcomputer to the L level to turn off the transistor TR4, and then the process proceeds to Step 6. When it is determined in Step 4 that the rotational speed is the set rotational speed or higher, the process proceeds to Step 7 to set the potential of the port A2 of the microcomputer to the H level to turn on the transistor TR4, and then the process proceeds to Step 6.

In Step 6 in FIG. 8, the map is searched with respect to the arithmetically operated rotational speed NE to perform the interpolation operation to arithmetically operate an ignition position θig, and then perform an arithmetical operation such that the ignition position θig is converted to the ignition timer clocking date Tig by the equation (1). Then, the process proceeds to Step 8 to clear the main routine requiring flag, and then returns to Step 2.

The interruption routine in FIG. 9 is executed every time the crank angle detection signals Vcr1 and Vcr2 are input to the port A1 of the microcomputer. In the interruption routine, it is first determined in Step 1 whether the present crank angle detection signal is the advanced side signal Vcr1. When it is determined that the present crank angle detection signal is not the advanced side signal, no operation is performed thereafter to finish the routine. When it is determined in Step 1 that the present crank angle detection signal is the advanced side signal Vcr1, the signal is recognized as a reference signal, and the process proceeds to Step 2 to set the ignition timer clocking data Tig in the ignition timer. Then in Step 3, the measurement value of the timer that counts the clock pulse is read to update the time data Tn for one rotation, and in Step 4, the main routine requiring flag is set to finish the routine. When the ignition timer completes the measurement of the ignition timer clocking data Tig, the main routine is interrupted to execute an unshown trigger instruction issuing routine is executed, and in the trigger instruction issuing routine, the potential of the port A3 of the microcomputer is set to the L level to issue the trigger instruction.

According to the algorithms in FIGS. 8 and 9, the rotational speed detection means 31*a* is constructed by Step 3 in FIG. 9 and Step 3 in FIG. 8, and the ignition position arithmetical operation means 31*b* is constructed by Step 3 in FIG. 8. The trigger instruction issuing means 31*c* is constructed by Step 2 in FIG. 9 and the trigger instruction issuing routine executed when the ignition timer completes the measurement of the ignition timer clocking data Tig. Further, the bypassing switch control means 31*d* is constructed by Steps 4, 5 and 7 in FIG. 8, which keeps the trigger signal bypassing switch 31B3 in the OFF state when the rotational speed of the internal combustion engine is the set value or lower, and keeps the trigger signal bypassing switch 31B3 in the ON state when the rotational speed of the internal combustion engine exceeds the set value.

The operation of the ignition device in FIG. 5 is as described below.

When the crankshaft of the internal combustion engine rotates, the exciter coil 2 generates the output voltages Vn1, Vp, Vn2 as shown in FIG. 7A. When the first negative half cycle of the output voltage Vn1 of the exciter coil 2 reaches the threshold level Vt at a crank angle position θ1, the transistor TR2 conducts to provide the first crank angle detection signal Vcr1 to the port A1 of the microcomputer as shown in FIG. 7B. At this time, the microcomputer executes the interruption routine in FIG. 9. If the first crank angle detection signal can be recognized as the reference signal in Step 1 of the interruption routine in FIG. 9, the ignition timer clocking data is set in the ignition timer in Step 2, then the time data Tn for one rotation is fetched in Step 3, and the rotational speed data NE is updated in Step 3 in FIG. 8. At this time, if it is determined in Step 4 in FIG. 8 that the rotational speed is lower than the set rotational speed, Step 5 is performed to set the potential (the bypassing switch driving signal) Sd of the port A2 of the microcomputer is set to the L level to turn off the transistor TR4. In this state, the negative half cycle of the output voltage Vn1 is reduced to the threshold level Vt at a crank angle position θ2 to turn off the transistor TR1, then the trigger signal Vgk is provided from the trigger power supply capacitor Ct of the first trigger circuit 31A to the gate of the first thyristor Th1 through the resistor R3, the differential capacitor Cd, and the diode D6, but the ignition capacitor Ci has not yet been charged at this time, and thus the thyristor Th1 does not conduct to cause no ignition operation.

When the exciter coil 2 generates the positive half cycle of the output voltage Vp at a crank angle position θ3, the ignition capacitor Ci is charged with the shown polarity, and the voltage Vc across the ignition capacitor Ci increases as shown in FIG. 7G.

Then, the exciter coil generates the negative half cycle of the output voltage Vn2, and when the negative half cycle of the output voltage Vn2 of the exciter coil 2 reaches the threshold level Vt at a crank angle position θ4, the transistor TR2 conducts, and the second crank angle detection signal Vcr2 is provided to the port A1 of the microcomputer as shown in FIG. 7B. When the negative half cycle of the output voltage Vn2 of the exciter coil peaks and then reaches below the threshold level Vt at a crank angle position θ5, the transistor TR1 is turned off. At this time, if the rotational speed of the engine is lower than the set value and the transistor TR4 is in the OFF state, the trigger signal Vgk is provided from the first trigger circuit 31A to the gate of the first thyristor Th1. This causes the first thyristor Th1 to conduct to discharge charges in the ignition capacitor Ci through the primary coil 1*a* of the ignition coil, thus inducing a high voltage for ignition in the secondary coil 1*b* of the ignition coil for an ignition operation.

The ignition position arithmetical operation map is comprised so that when the rotational speed of the engine is below the set value, the value of the ignition timer clocking data Tig arithmetically operated by the microcomputer becomes sufficiently large, thus preventing the ignition timer from completing the measurement of the ignition timer clocking data at a position advanced from the crank angle position where the trigger signal is provided from the first trigger circuit 31A to the first thyristor Th1. Therefore, when the rotational speed of the engine is below the set value, no trigger signal is provided from the second trigger circuit 31B to the second thyristor Th2 for the ignition operation, and the ignition operation is performed merely when the trigger signal is provided from the first trigger circuit 31A to the first thyristor Th1.

When the first negative half cycle of the output voltage Vn1 of the exciter coil reaches the threshold level Vt at a crank angle position θ6, the first crank angle detection signal Vcr1 is provided to the port A1 of the microcomputer. The microcomputer recognizes the first crank angle detection signal Vcr1 as the reference signal to perform the interruption routine in FIG. 9. In Step 2, the ignition timer clocking data Tig is set in the ignition timer to start the measurement, and then in Step 3, the time data Tn for one rotation is fetched to update the rotational speed data NE in Step 3 in FIG. 8. When the rotational speed is the set rotational speed or higher, Step 7 in FIG. 8 is performed to set the potential (the bypassing switch driving signal) Sd of the port A2 of the microcomputer is set to the H level to turn on the transistor TR4.

Then, when the negative half cycle of the output voltage Vn1 reaches the threshold level or lower at a crank angle position θ7, the first trigger circuit 31A generates the trigger signal Vgk, but the trigger signal is bypassed from the first thyristor Th1 through between the collector and the emitter of the transistor TR4, and thus no trigger signal is provided to the thyristor Th1 by the trigger signal Vgk.

If the ignition capacitor Ci is charged with the positive half cycle of the output voltage Vp generated by the exciter coil at a crank angle position θ8, and then the ignition timer completes the measurement of the ignition timer clocking data Tig at a crank angle position θ9, the potential of the port A3 of the microcomputer is set to the L level to issue the trigger instruction to turn on the transistor TR5, thus the trigger signal Vgk' (FIG. 7D) is provided from the second trigger circuit 31B to the second thyristor Th2 for the ignition operation. Then, when the negative half cycle of the output voltage Vn2 of the exciter coil reaches below the threshold level at a crank angle position θ11, the first trigger circuit 31A generates the trigger signal Vgk, but the trigger signal Vgk is bypassed by the transistor TR4, and not provided to the first thyristor Th1.

As described above, when the rotational speed of the engine is the set rotational speed or higher, the transistor TR4 that constitutes the trigger signal bypassing switch is kept in the ON state, thus no trigger signal is provided from the first trigger circuit 31A to the first thyristor Th1, and the ignition operation is performed when the trigger signal Vgk' is provided from the second trigger circuit 31B to the second thyristor Th2 at the arithmetically operated ignition position.

In the above described embodiment, the trigger signal bypassing switch 31B3 is provided, but if the position where the second trigger circuit 31B provides the trigger signal Vgk' to the second thyristor Th2 when the rotational speed of the engine reaches the set speed or higher is always advanced from the position where the first trigger circuit 31A generates the trigger signal Vgk, the trigger signal may be provided from the first trigger circuit 31A to the first thyristor Th1 without a hitch when the rotational speed of the engine reaches the set speed or higher, thus the trigger signal bypassing switch 31B3 and the control means thereof may be omitted.

Fourth Embodiment

Figure 10:
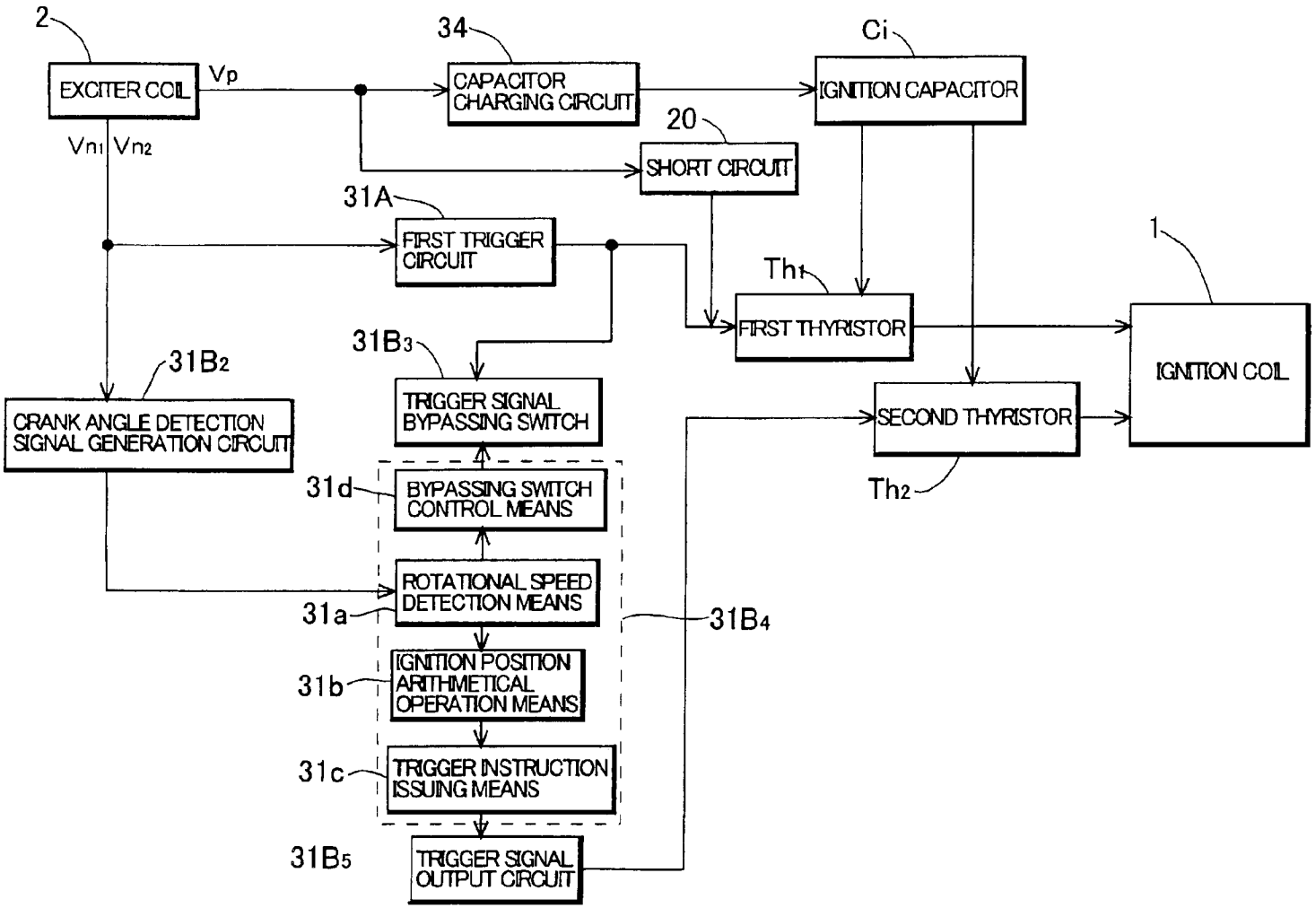
FIG. 10 is a block diagram of an entire construction of a fourth embodiment according to the invention.

In the third embodiment in FIG. 5, the reverse bias circuit comprised of the first feedback diode D1 is provided in order to construct the trigger inhibiting circuit that inhibits the first thyristor Th1 from being triggered by the first negative half cycle of the output voltage Vn1 formerly provided by the exciter coil. Also when the trigger inhibiting circuit is comprised of a short circuit 20 similar to that used in the embodiment in FIG. 4 instead of the reverse bias circuit, the trigger inhibiting circuit may be comprised so that a discharging switch circuit comprised of a first thyristor Th1 and a second thyristor Th2 is provided to provide trigger signals from a first trigger circuit 31A and a second trigger circuit 31B to the first thyristor Th1 and the second thyristor Th2, respectively. FIG. 10 shows a construction of an ignition device when the short circuit 20 is used instead of the reverse bias circuit.

Fifth Embodiment

Figure 11:
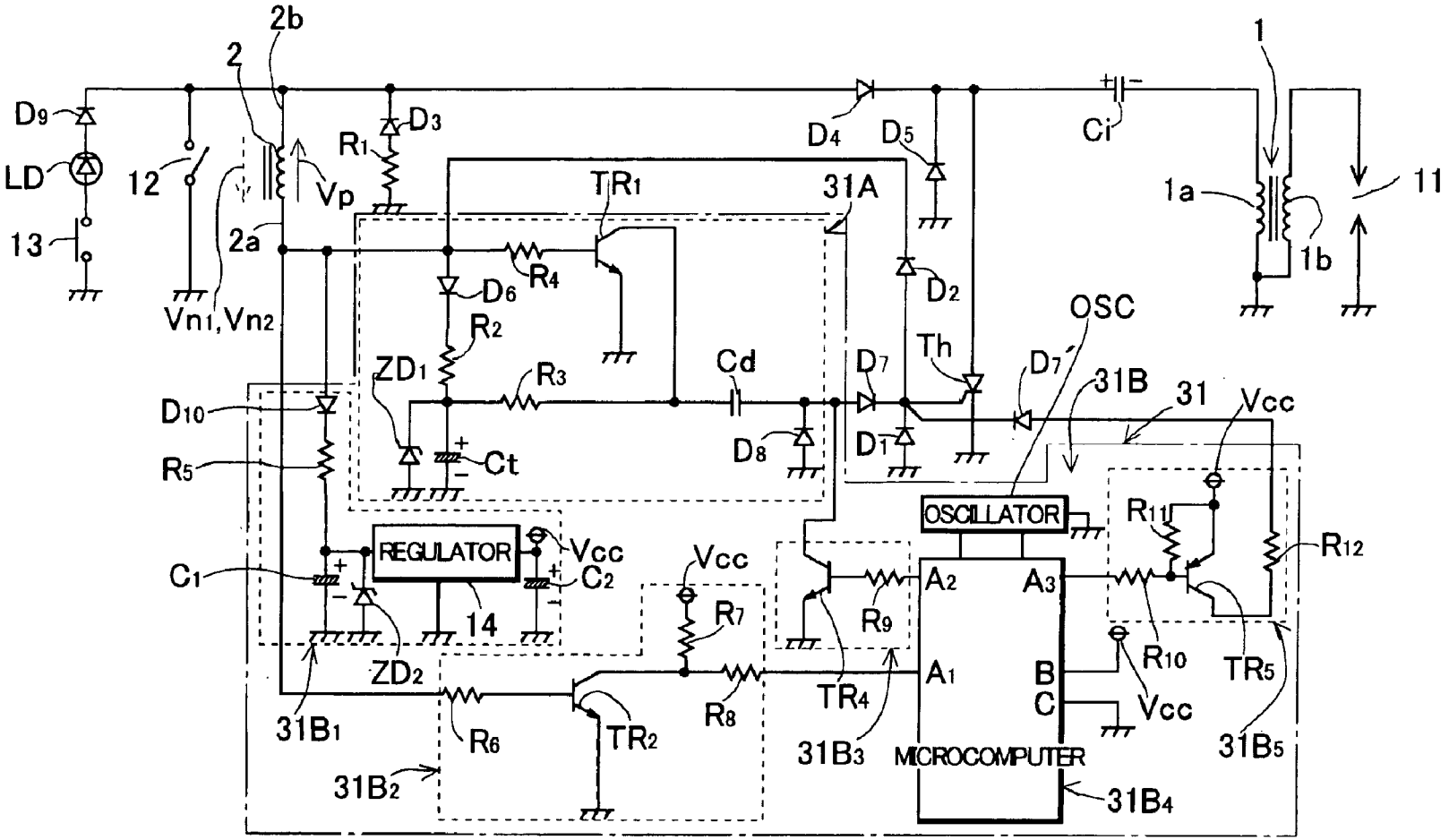
FIG. 11 is a circuit diagram of a construction of hardware of a fifth embodiment according to the invention.

As described above, when the discharging switch circuit is comprised of the first thyristor Th1 and the second thyristor Th2 to trigger the first thyristor Th1 at an ignition position determined by a waveform of the negative half cycle of the output voltage Vn2 of the exciter coil 2, and trigger the second thyristor Th2 at an arithmetically operated ignition position, the ignition operation can be performed by triggering the second thyristor even if the reverse bias circuit or the short circuit operate to prevent the first thyristor from being triggered, thus allowing an advanced width of the ignition position to be enlarged. However, in the invention, the discharging switch circuit does not require to be always comprised of the first thyristor and the second thyristor as described above, but may be comprised of a single thyristor Th as shown in FIG. 11 to provide a trigger signal from a first trigger circuit 31A and a second trigger circuit 31B to the thyristor Th. In this case, an entire construction of the ignition device including means constructed by the microcomputer is as shown in FIG. 12.

Figure 12:
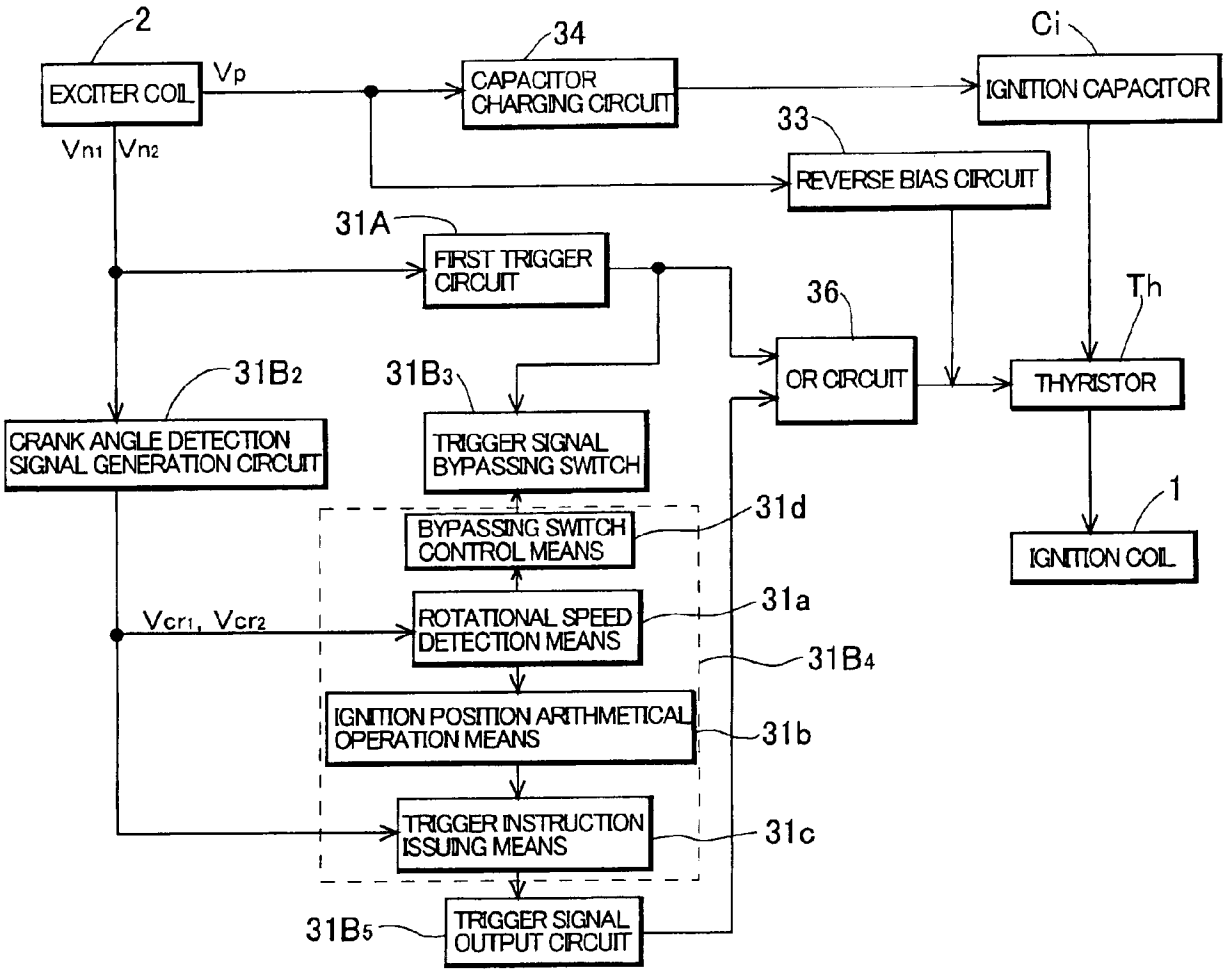
FIG. 12 is a block diagram of an entire construction of a fifth embodiment according to the invention.

In the example in FIGS. 11 and 12, a diode D7' is inserted between an output terminal of the second trigger circuit 31B and a gate of the thyristor Th in order to prevent interference between the first trigger circuit and the second trigger circuit, and an OR circuit 36 is comprised of a diode D7 and the diode D7'.

Also in the embodiment in FIG. 11, a first feedback diode D1 is connected between the gate and a cathode of the thyristor Th, and a positive current feedback circuit is comprised of the first feedback diode D1 and the second feedback diode D2 connected between the gate of the thyristor Th and one end 2*a* of an exciter coil 2. Also, a third feedback diode D3 is connected between the other end 2*b* of the exciter coil and the ground through a resistor R1, and a negative current feedback circuit is comprised of the third feedback diode.

A reverse bias circuit is comprised of the first feedback diode D1, and a trigger inhibiting circuit is comprised of the reverse bias circuit, which inhibits the thyristor Th from being triggered when a current flowing from the exciter coil 2 through between an anode and the cathode of the thyristor Th is detected and when a charging current of the ignition capacitor Ci is detected.

Sixth Embodiment

Figure 13:
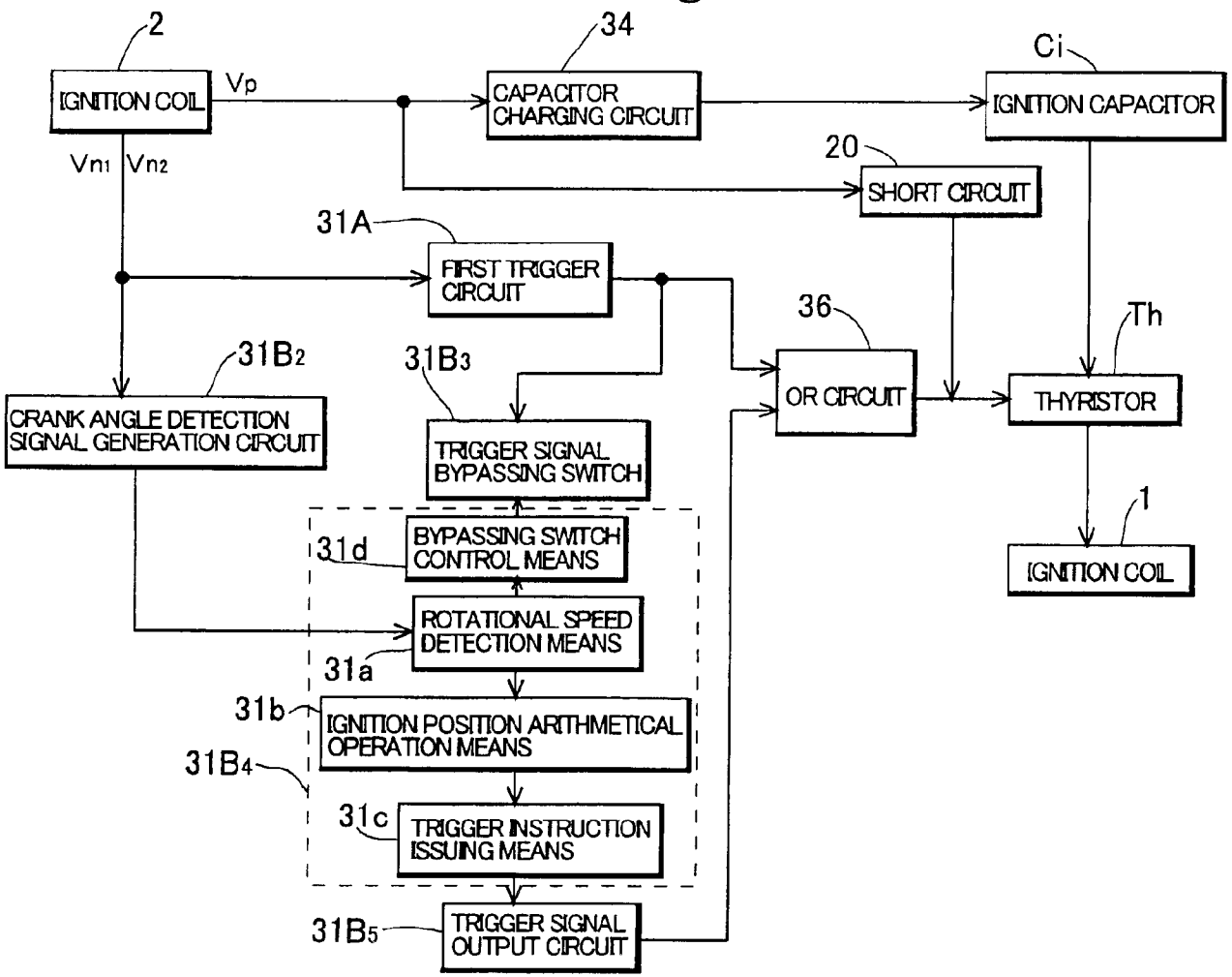
FIG. 13 is a block diagram of an entire construction of a sixth embodiment according to the invention.

FIG. 13 shows an entire construction of a sixth embodiment of the invention. In this embodiment, a short circuit 20 is provided in order to prevent a thyristor Th from being triggered by a negative half cycle of an output voltage Vn1 formerly generated by an exciter coil 2. Other parts are comprised similarly to the example in FIGS. 11 and 12. The short circuit 20 may be comprised similarly to that used in the embodiment in FIG. 4.

In each of the above described embodiments, the construction of the ignition device for a single cylinder of the internal combustion engine, but when the internal combustion engine is a multi-cylinder internal combustion engine having two or more cylinders, stators 7 equal in number to the cylinders are placed on a magnet rotor 6 in FIG. 2, and an ignition unit and an ignition coil as described above are provided for an exciter coil of each stator, thereby constructing an ignition device that ignites multiple cylinders.

In each embodiment, a magneto generator may be comprised so that two permanent magnets are attached to an outer periphery of a flywheel at a 180° interval, and an exciter coil 2 generates one-and-a-half cycle of an AC voltage twice for one rotation at a 180° interval, and an ignition coil 1 may be comprised of a known double ended ignition coil to obtain an ignition device that ignites two cylinders of a two-cycle internal combustion engine.

The double ended ignition coil is adapted so that one end of a secondary coil of an ignition coil is not grounded, and both ends of the secondary coil are connected to ungrounded terminals of two ignition plugs mounted to two cylinders of an internal combustion engine to cause the two ignition plugs to spark at the same time when a high voltage for ignition is generated in the secondary coil.

Although some preferred embodiments of the invention have been described and illustrated with reference to the accompanying drawings, it will be understood by those skilled in the art that they are by way of examples, and that various changes and modifications may be made without departing from the spirit and scope of the invention, which is defined only to the appended claims.

What is claimed is:

1. A capacitor discharge ignition device for an internal combustion engine comprises:

a magneto generator having an exciter coil that generates one-and-a-half cycle of an AC voltage constituted by a positive half cycle of an output voltage and first and second negative half cycles of output voltages generated before and after said positive half cycle of the output voltage, respectively, at least once during one rotation of a crankshaft;

an ignition coil;

an ignition capacitor that is charged with one polarity with the positive half cycle of the output voltage of said exciter coil;

a thyristor that is turned on when a trigger signal is provided to discharge charges stored in said ignition capacitor through a primary coil of said ignition coil;

a thyristor trigger circuit that provides a trigger signal to said thyristor at an ignition position in said internal combustion engine using the negative half cycle of the output voltage of said exciter coil as a power supply voltage; and a trigger inhibiting circuit that inhibits said thyristor from being triggered when a current flowing from said exciter coil through said thyristor is detected and when a charging current of said ignition capacitor is detected.

2. The capacitor discharge ignition device for an internal combustion engine according to claim 1, wherein said trigger inhibiting circuit is comprised of a reverse bias circuit that applies a reverse bias voltage between a gate and a cathode of said thyristor when the current flowing from said exciter coil through said thyristor is detected and when the charging current of said ignition capacitor is detected.

3. The capacitor discharge ignition device for an internal combustion engine according to claim 1, further comprising a positive current feedback circuit provided between one end of said exciter coil and the ground in order to construct a return circuit of a current flowing out of said exciter coil when said exciter coil generates the positive half cycle of the output voltage, and a negative current feedback circuit provided between the other end of said exciter coil and the ground in order to construct a return circuit of a current flowing out of said exciter coil when said exciter coil generates the negative half cycle of the output voltage, wherein said positive current feedback circuit is comprised of a first feedback diode connected between the gate and the cathode of said thyristor with its cathode directed to the gate of said thyristor, and a second feedback diode connected between the gate of said thyristor and one end of said exciter coil with its anode directed to the gate of said thyristor, said negative current feedback circuit comprises a third feedback diode connected between the other end of said exciter coil and the ground with its anode directed to the ground, and the reverse bias circuit is comprised of said first feedback diode, which applies the reverse bias voltage between the gate and the cathode of said thyristor when the current flowing from said exciter coil through said thyristor is detected and when the charging current of said ignition capacitor is detected, and said trigger inhibiting circuit is comprised of said reverse bias circuit.

4. The capacitor discharge ignition device for an internal combustion engine according to claim 1, wherein said thyristor trigger circuit is comprised so as to recognize a crank angle position corresponding to a specific phase of the negative half cycle of the output voltage of said exciter coil as an ignition position of said internal combustion engine and provide a trigger signal to said thyristor when said ignition position is detected.

5. The capacitor discharge ignition device for an internal combustion engine according to claim 1, wherein said thyristor trigger circuit comprises:

a trigger power supply capacitor that has one end grounded and the other end connected to one end of said exciter coil through a backflow inhibiting diode and a charging time constant adjusting resistor, and is charged with the negative half cycle of the output voltage generated by said exciter coil; a trigger controlling transistor whose collector is connected to an ungrounded terminal of said trigger power supply capacitor through a discharging resistor, whose emitter is grounded, and whose base is connected to one end of said exciter coil through a base resistor, and that is turned on when said exciter coil generates a negative half cycle of an output voltage higher than a threshold level; a differential capacitor that has one end connected to the ungrounded terminal of said trigger power supply capacitor through said discharging resistor; and a trigger signal providing diode whose anode is connected to the other end of said differential capacitor and whose cathode is connected to the gate of said thyristor, and is comprised so as to provide a trigger signal to said thyristor through said differential capacitor by charges remaining in said trigger power supply capacitor when the negative half cycle of the output voltage generated by said exciter coil peaks and then reaches below the threshold level to turn off said trigger controlling transistor, and a charging time constant and a discharging time constant of said trigger power supply capacitor are set to values appropriate for charges required for providing the trigger signal to said thyristor to remain in said trigger power supply capacitor.

6. The capacitor discharge ignition device for an internal combustion engine according to claim 1, further comprising the positive current feedback circuit provided between one end of said exciter coil and the ground in order to construct the return circuit of the current flowing out of said exciter coil when said exciter coil generates the positive half cycle of the output voltage, and the negative current feedback circuit provided between the other end of said exciter coil and the ground in order to construct the return circuit of the current flowing out of said exciter coil when said exciter coil generates the negative half cycle of the output voltage, wherein said positive current feedback circuit is comprised of the first feedback diode connected between the gate and the cathode of said thyristor with its cathode directed to the gate of said thyristor, and the second feedback diode connected between the gate of said thyristor and one end of said exciter coil with its anode directed to the gate of said thyristor, said negative current feedback circuit comprises the third feedback diode connected between the other end of said exciter coil and the ground with its anode directed to the ground, a resistance element is connected in series with said third feedback diode, and a series circuit of said third feedback diode and the resistance element is connected between the other end of said exciter coil and the ground, a series circuit of a detection switch that is turned on when a state where warning indication is required occurs and a light emitting diode as warning indication means is connected between the other end of said exciter coil and the ground with an anode of said light emitting diode directed to the ground, and the reverse bias circuit is comprised of said first feedback diode, which applies the reverse bias voltage between the gate and the cathode of said thyristor when the current flowing from said exciter coil through said thyristor is detected and when the charging current of said ignition capacitor is detected, and said trigger inhibiting circuit is comprised of said reverse bias circuit.

7. The capacitor discharge ignition device for an internal combustion engine according to claim 1, wherein said trigger inhibiting circuit is comprised of a short circuit that short-circuits said thyristor between the gate and the cathode when the current flowing from said exciter coil through said thyristor is detected and when the charging current of said ignition capacitor is detected.

8. The capacitor discharge ignition device for an internal combustion engine according to claim 1, further comprising the positive current feedback circuit provided between one end of said exciter coil and the ground in order to construct the return circuit of the current flowing out of said exciter coil when said exciter coil generates the positive half cycle of the output voltage, and the negative current feedback circuit provided between the other end of said exciter coil and the ground in order to construct the return circuit of the current flowing out of said exciter coil when said exciter coil generates the negative half cycle of the output voltage, wherein said positive current feedback circuit is comprised of the first feedback diode connected between the gate and the cathode of said thyristor with its cathode directed to the gate of said thyristor, and the second feedback diode connected between the gate of said thyristor and one end of said exciter coil with its anode directed to the gate of said thyristor, said negative current feedback circuit comprises the third feedback diode connected between the other end of said exciter coil and the ground with its anode directed to the ground, and said trigger inhibiting circuit is comprised of a short-circuiting switch provided so as to short-circuit said thyristor between the gate and the cathode when the thyristor conducts, and a short-circuiting switch drive circuit that causes said short-circuiting switch to conduct when a forward voltage drop occurring across said first feedback diode is detected.

9. The capacitor discharge ignition device for an internal combustion engine according to claim 1, further comprising the positive current feedback circuit provided between one end of said exciter coil and the ground in order to construct the return circuit of the current flowing out of said exciter coil when said exciter coil generates the positive half cycle of the output voltage, and the negative current feedback circuit provided between the other end of said exciter coil and the ground in order to construct the return circuit of the current flowing out of said exciter coil when said exciter coil generates the negative half cycle of the output voltage, wherein said positive current feedback circuit is comprised of the first feedback diode connected between the gate and the cathode of said thyristor with its cathode directed to the gate of said thyristor, and the second feedback diode connected between the gate of said thyristor and one end of said exciter coil with its anode directed to the gate of said thyristor, said negative current feedback circuit comprises the third feedback diode connected between the other end of said exciter coil and the ground with its anode directed to the ground, and said trigger inhibiting circuit is comprised of a first transistor whose collector and emitter are connected to the gate and the cathode of said thyristor, respectively, a second transistor whose collector and emitter are connected to a base and the emitter of said first transistor and whose base is connected to a cathode of said first feedback diode, and a circuit that provides a base current to said first transistor and second transistor.

10. A capacitor discharge ignition device for an internal combustion engine comprises:

a magneto generator having an exciter coil that generates one-and-a-half cycle of an AC voltage constituted by a positive half cycle of an output voltage and first and second negative half cycles of output voltages generated before and after said positive half cycle of the output voltage, respectively, at least once during one rotation of a crankshaft;

an ignition coil;

an ignition capacitor that is charged with one polarity with the positive half cycle of the output voltage of said exciter coil;

a discharging switch circuit that is comprised so as to have a first thyristor and a second thyristor, and discharge charges stored in said ignition capacitor through a primary coil of said ignition coil when either said first thyristor or said second thyristor is turned on;

a thyristor trigger circuit that is provided so as to operate using the negative half cycle of the output voltage of said exciter coil as a power supply voltage, and provides a trigger signal to either said first thyristor or said second thyristor at an ignition position in said internal combustion engine; and a trigger inhibiting circuit that inhibits said first thyristor from being triggered when a current flowing from said exciter coil through said thyristor is detected and when a charging current of said ignition capacitor is detected, wherein said thyristor trigger circuit comprises a first trigger circuit that provides a trigger signal to said first thyristor using said exciter coil as a signal source while said exciter coil is generating the negative half cycle of the output voltage, and a second trigger circuit that detects a rotational speed of said internal combustion engine from the output of said exciter coil and provides a trigger signal to said second thyristor at an ignition position arithmetically operated with respect to the detected rotational speed.

11. The capacitor discharge ignition device for an internal combustion engine according to claim 10, wherein said trigger inhibiting circuit is comprised of a reverse bias circuit that applies a reverse bias voltage between a gate and a cathode of said first thyristor when the current flowing from said exciter coil through said first thyristor is detected and when the charging current of said ignition capacitor is detected.

12. The capacitor discharge ignition device for an internal combustion engine according to claim 10, further comprising a positive current feedback circuit provided between one end of said exciter coil and the ground in order to construct a return circuit of a current flowing out of said exciter coil when said exciter coil generates the positive half cycle of the output voltage, and a negative current feedback circuit provided between the other end of said exciter coil and the ground in order to construct a return circuit of a current flowing out of said exciter coil when said exciter coil generates the negative half cycle of the output voltage, wherein said positive current feedback circuit is comprised of a first feedback diode connected between the gate and the cathode of said first thyristor with its cathode directed to the gate of said first thyristor, and a second feedback diode connected between the gate of said first thyristor and one end of said exciter coil with its anode directed to the gate of said thyristor, said negative current feedback circuit comprises a third feedback diode connected between the other end of said exciter coil and the ground with its anode directed to the ground, and the reverse bias circuit is comprised of said first feedback diode, which applies the reverse bias voltage between the gate and the cathode of said thyristor when the current flowing from said exciter coil through said thyristor is detected and when the charging current of said ignition capacitor is detected, and said trigger inhibiting circuit is comprised of said reverse bias circuit.

13. The capacitor discharge ignition device for an internal combustion engine according to claim 10, wherein said first trigger circuit is comprised so as to recognize a crank angle position corresponding to a specific phase of the negative half cycle of the output voltage of said exciter coil as an ignition position of said internal combustion engine and provide a trigger signal to said thyristor when said ignition position is detected, and said second trigger circuit comprises a crank angle detection signal generation circuit that generates a crank angle detection signal when the negative half cycle of the output voltage of said exciter coil reaches a certain value; a power supply circuit that uses the negative half cycle of the output voltage of said exciter coil as an input to output a fixed DC voltage; a microcomputer that is provided so as to operate using said crank angle detection signal as an input and the output voltage of said power supply circuit as a power supply voltage, and constructs rotational speed detection means that uses said crank angle detection signal generated when said first negative half cycle of the output voltage reaches a certain value as a reference signal to detect a rotational speed of said internal combustion engine from a production interval of said reference signal, ignition position arithmetical operation means that arithmetically operates an ignition position of said internal combustion engine with respect to the rotational speed detected by said rotational speed detection means, and trigger instruction issuing means that issues a trigger instruction when the ignition position arithmetically operated by said ignition position arithmetical operation means is detected; and a trigger signal output circuit that outputs a trigger signal to be provided to said second thyristor when said trigger instruction issuing means issues the trigger instruction.

14. The capacitor discharge ignition device for an internal combustion engine according to claim 10, further comprising a trigger signal bypassing switch provided so as to bypass from said first thyristor the trigger signal provided from said first trigger circuit to said first thyristor in an ON state; and bypassing switch control means that keeps said trigger signal bypassing switch in an OFF state when the rotational speed of said internal combustion engine is below a set value, and keeps said trigger signal bypassing switch in an ON state when said rotational speed of the internal combustion engine exceeds the set value.

15. The capacitor discharge ignition device for an internal combustion engine according to claim 10, further comprising the positive current feedback circuit provided between one end of said exciter coil and the ground in order to construct the return circuit of the current flowing out of said exciter coil when said exciter coil generates the positive half cycle of the output voltage, and the negative current feedback circuit provided between the other end of said exciter coil and the ground in order to construct the return circuit of the current flowing out of said exciter coil when said exciter coil generates the negative half cycle of the output voltage, wherein said positive current feedback circuit is comprised of the first feedback diode connected between the gate and the cathode of said first thyristor with its cathode directed to the gate of said first thyristor, and the second feedback diode connected between the gate of said first thyristor and one end of said exciter coil with its anode directed to the gate of said first thyristor, said negative current feedback circuit comprises the third feedback diode connected between the other end of said exciter coil and the ground with its anode directed to the ground, a resistance element is connected in series with said third feedback diode, a series circuit of said third feedback diode and the resistance element is connected between the other end of said exciter coil and the ground, a series circuit of a detection switch that is turned on when a state where warning indication is required occurs and a light emitting diode as warning indication means is connected between the other end of said exciter coil and the ground with an anode of said light emitting diode directed to the ground, and the reverse bias circuit is comprised of said first feedback diode, which applies the reverse bias voltage between the gate and the cathode of said thyristor when the current flowing from said exciter coil through said thyristor is detected and when the charging current of said ignition capacitor is detected, and said trigger inhibiting circuit is comprised of said reverse bias circuit.

16. The capacitor discharge ignition device for an internal combustion engine according to claim 10, wherein said trigger inhibiting circuit is comprised of a short circuit that short-circuits said first thyristor between the gate and the cathode when the current flowing from said exciter coil through said first thyristor is detected and when the charging current of said ignition capacitor is detected.

17. The capacitor discharge ignition device for an internal combustion engine according to claim 10, further comprising the positive current feedback circuit provided between one end of said exciter coil and the ground in order to construct the return circuit of the current flowing out of said exciter coil when said exciter coil generates the positive half cycle of the output voltage, and the negative current feedback circuit provided between the other end of said exciter coil and the ground in order to construct the return circuit of the current flowing out of said exciter coil when said exciter coil generates the negative half cycle of the output voltage, wherein said positive current feedback circuit is comprised of the first feedback diode connected between the gate and the cathode of said first thyristor with its cathode directed to the gate of said first thyristor, and the second feedback diode connected between the gate of said first thyristor and one end of said exciter coil with its anode directed to the gate of said first thyristor, said negative current feedback circuit comprises the third feedback diode connected between the other end of said exciter coil and the ground with its anode directed to the ground, a resistance element is connected in series with said third feedback diode, a series circuit of said third feedback diode and the resistance element is connected between the other end of said exciter coil and the ground, a series circuit of a detection switch that is turned on when a state where warning indication is required occurs and a light emitting diode as warning indication means is connected between the other end of said exciter coil and the ground with an anode of said light emitting diode directed to the ground, and said trigger inhibiting circuit is comprised of the short circuit that short-circuits said first thyristor between the gate and the cathode when the current flowing from said exciter coil through said first thyristor is detected and when the charging current of said ignition capacitor is detected.

* * * * *

UNITED STATES PATENT AND TRADEMARK OFFICE

CERTIFICATE OF CORRECTION

PATENT NO. : 6,889,677 B2
DATED : May 10, 2005
INVENTOR(S) : Fujima et al.

It is certified that error appears in the above-identified patent and that said Letters Patent is hereby corrected as shown below:

Column 2,
Line 59, after "magneto" insert -- generator having an exciter coil that generates one-and-a-half cycle of an AC --.

Column 7,
Line 41, delete "02" and inssert -- θ2 --.

Signed and Sealed this

Nineteenth Day of July, 2005

JON W. DUDAS
*Director of the United States Patent and Trademark Office*